US007342509B2

(12) United States Patent
Tauchi

(10) Patent No.: US 7,342,509 B2
(45) Date of Patent: Mar. 11, 2008

(54) IN-VEHICLE RADIO APPARATUS

(75) Inventor: Nobutaka Tauchi, Toyoake (JP)

(73) Assignee: DENSO CORPORATION, Kariya (JP)

( * ) Notice: Subject to any disclaimer, the term of this patent is extended or adjusted under 35 U.S.C. 154(b) by 429 days.

(21) Appl. No.: 11/036,142

(22) Filed: Jan. 18, 2005

(65) Prior Publication Data

US 2005/0168350 A1 Aug. 4, 2005

(30) Foreign Application Priority Data

Jan. 22, 2004 (JP) ..... 2004-014364
Apr. 11, 2004 (JP) ..... 2004-320591

(51) Int. Cl.
*G08G 1/09* (2006.01)

(52) U.S. Cl. ..... 340/905; 340/902; 340/904; 340/995.2; 455/99

(58) Field of Classification Search ..... 340/902, 340/903, 906, 904, 905, 995.12, 995.19, 340/995.2; 455/73, 95, 99; 701/208, 209, 701/211, 213
See application file for complete search history.

(56) References Cited

U.S. PATENT DOCUMENTS 5,083,125 A * 1/1992 Brown et al. ..... 340/906
5,402,117 A * 3/1995 Zijderhand ..... 340/905
6,008,741 A * 12/1999 Shinagawa et al. ..... 340/907
6,292,109 B1 * 9/2001 Murano et al. ..... 340/903
6,337,637 B1 1/2002 Kubota et al.
6,516,273 B1 * 2/2003 Pierowicz et al. ..... 701/301
6,788,964 B1 * 9/2004 Satomura et al. ..... 455/575.9
2005/0140523 A1 * 6/2005 Publicover ..... 340/907

FOREIGN PATENT DOCUMENTS

JP A-2000-339591 A 12/2000
JP A-2002-260194 9/2002

* cited by examiner

*Primary Examiner*—Brent A. Swarthout
(74) *Attorney, Agent, or Firm*—Posz Law Group, PLC

(57) ABSTRACT

In an in-vehicle radio apparatus to radio-transmit information from a vehicle about to enter an intersection, the interference between a radio signal transmitted from the vehicle and a radio signal transmitted from another vehicle is suppressed. Further, an approach direction of the vehicle to the intersection can be accurately transmitted. In the radio apparatus to transmit a radio signal by using a spread spectrum method, it is determined that the vehicle has approached a first distance from the intersection, and based on the determination, a spread code corresponding to an approach direction of the vehicle to the intersection is allocated as a spread code used for transmission.

23 Claims, 12 Drawing Sheets

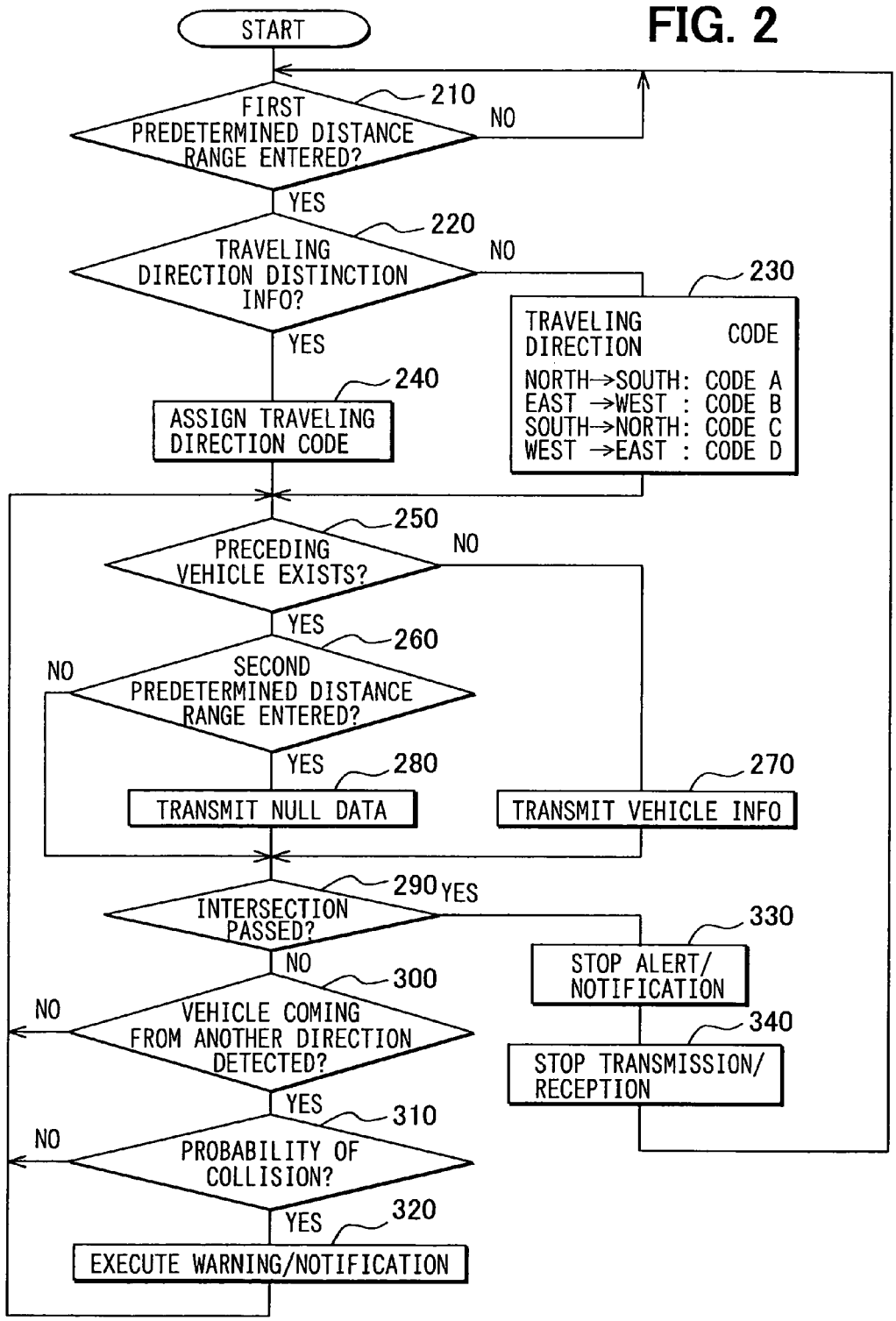
FIG. 2
START
FIRST PREDETERMINED DISTANCE RANGE ENTERED?
210
NO
YES
TRAVELING DIRECTION DISTINCTION INFO?
220
NO
YES
230
TRAVELING DIRECTION
CODE
NORTH→SOUTH: CODE A
EAST →WEST : CODE B
SOUTH→NORTH: CODE C
WEST →EAST : CODE D
240
ASSIGN TRAVELING DIRECTION CODE
250
PRECEDING VEHICLE EXISTS?
NO
YES
260
NO
SECOND PREDETERMINED DISTANCE RANGE ENTERED?
YES
280
TRANSMIT NULL DATA
270
TRANSMIT VEHICLE INFO
290
YES
INTERSECTION PASSED?
330
STOP ALERT/ NOTIFICATION
NO
300
NO
VEHICLE COMING FROM ANOTHER DIRECTION DETECTED?
340
STOP TRANSMISSION/ RECEPTION
YES
310
NO
PROBABILITY OF COLLISION?
YES
320
EXECUTE WARNING/NOTIFICATION

| APPROACH DIRECTION | APPROACH INTERSECTION | ALLOCATED CODE | TRANSMISSION END POSITION |
|---|---|---|---|
| N→S | INTERSECTION 30 | CODE A | INTERSECTION 30 |
| | INTERSECTION 31 | CODE E | INTERSECTION 31 |
| S→N | INTERSECTION 30 | CODE C | INTERSECTION 30 |
| | INTERSECTION 31 | CODE F | INTERSECTION 31 |
| E→W | INTERSECTION 30 | CODE B | INTERSECTION 31 |
| | INTERSECTION 31 | | |
| W→E | INTERSECTION 30 | CODE D | INTERSECTION 30 |
| | INTERSECTION 31 | | |

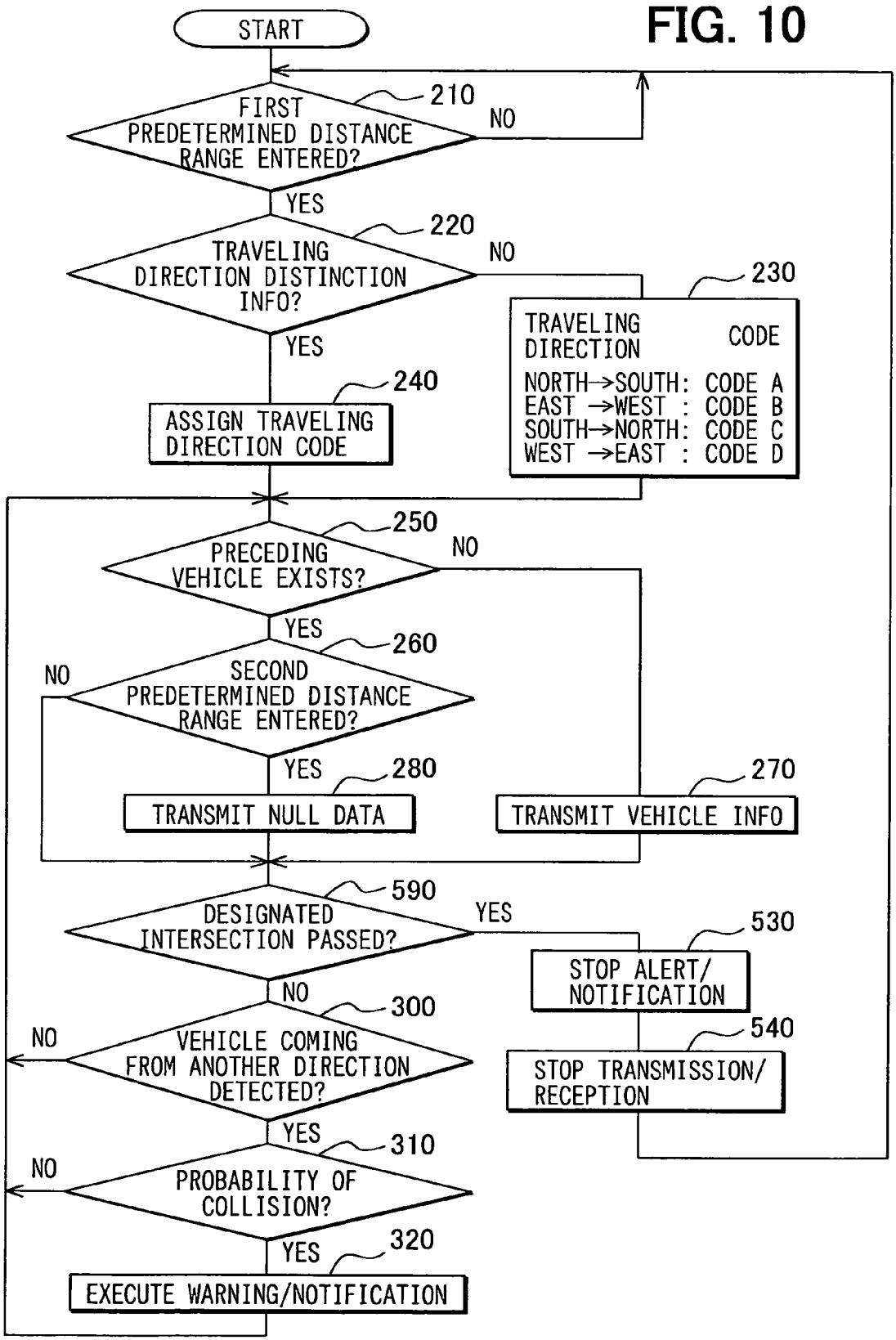
FIG. 10
START
FIRST PREDETERMINED DISTANCE RANGE ENTERED?
210
NO
YES
TRAVELING DIRECTION DISTINCTION INFO?
220
NO
YES
230
TRAVELING DIRECTION CODE
NORTH→SOUTH: CODE A
EAST →WEST : CODE B
SOUTH→NORTH: CODE C
WEST →EAST : CODE D
240
ASSIGN TRAVELING DIRECTION CODE
250
PRECEDING VEHICLE EXISTS?
NO
YES
260
NO
SECOND PREDETERMINED DISTANCE RANGE ENTERED?
YES
280
TRANSMIT NULL DATA
270
TRANSMIT VEHICLE INFO
590
DESIGNATED INTERSECTION PASSED?
YES
530
STOP ALERT/ NOTIFICATION
NO
300
NO
VEHICLE COMING FROM ANOTHER DIRECTION DETECTED?
540
STOP TRANSMISSION/ RECEPTION
YES
310
NO
PROBABILITY OF COLLISION?
YES
320
EXECUTE WARNING/NOTIFICATION

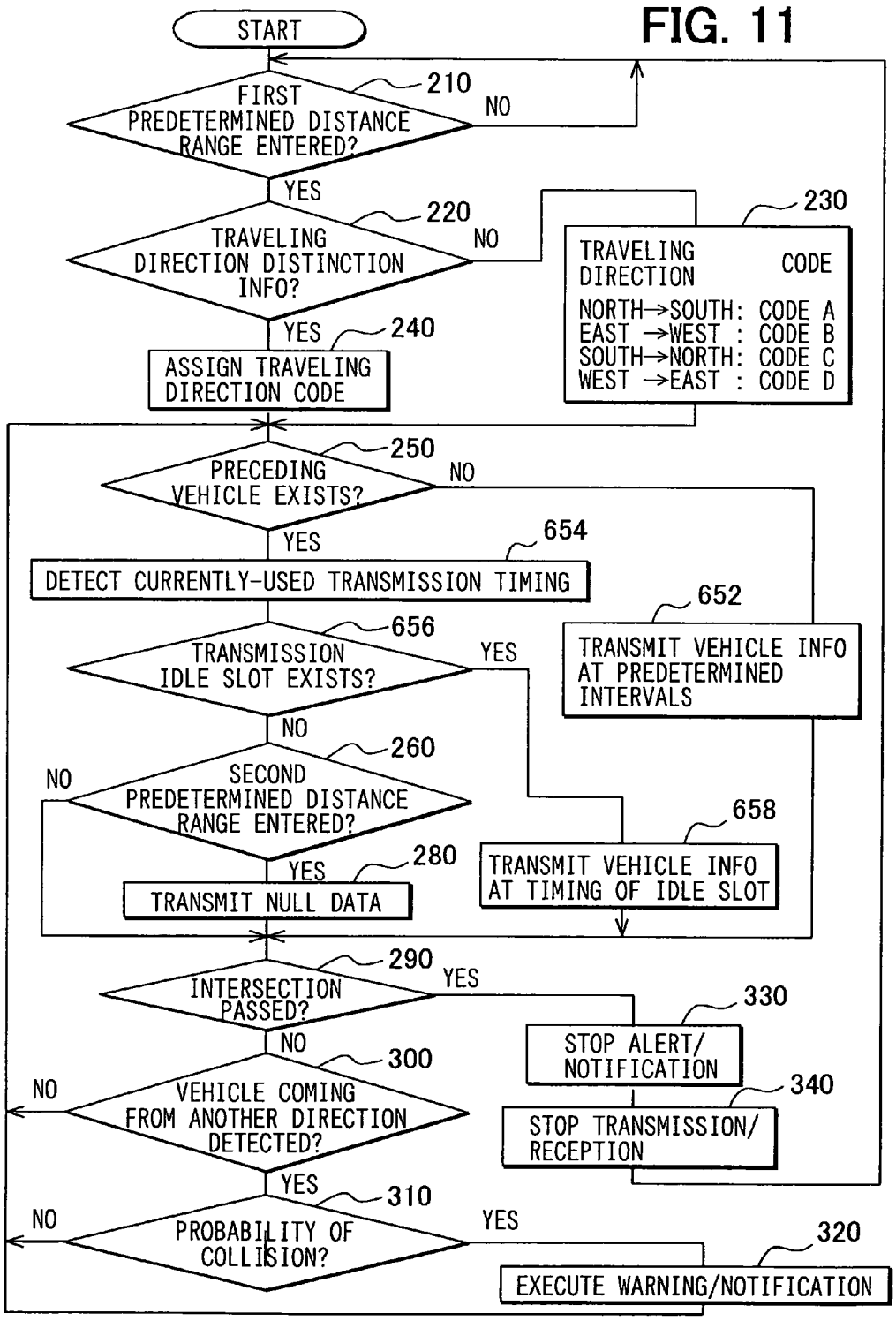
FIG. 11
START
FIRST PREDETERMINED DISTANCE RANGE ENTERED?
210
NO
YES
TRAVELING DIRECTION DISTINCTION INFO?
220
NO
YES
240
ASSIGN TRAVELING DIRECTION CODE
230
TRAVELING DIRECTION CODE
NORTH→SOUTH: CODE A
EAST →WEST : CODE B
SOUTH→NORTH: CODE C
WEST →EAST : CODE D
PRECEDING VEHICLE EXISTS?
250
NO
YES
654
DETECT CURRENTLY-USED TRANSMISSION TIMING
656
TRANSMISSION IDLE SLOT EXISTS?
YES
652
TRANSMIT VEHICLE INFO AT PREDETERMINED INTERVALS
NO
260
SECOND PREDETERMINED DISTANCE RANGE ENTERED?
NO
YES
280
TRANSMIT NULL DATA
658
TRANSMIT VEHICLE INFO AT TIMING OF IDLE SLOT
290
INTERSECTION PASSED?
YES
330
STOP ALERT/ NOTIFICATION
NO
300
VEHICLE COMING FROM ANOTHER DIRECTION DETECTED?
NO
340
STOP TRANSMISSION/ RECEPTION
YES
310
PROBABILITY OF COLLISION?
NO
YES
320
EXECUTE WARNING/NOTIFICATION

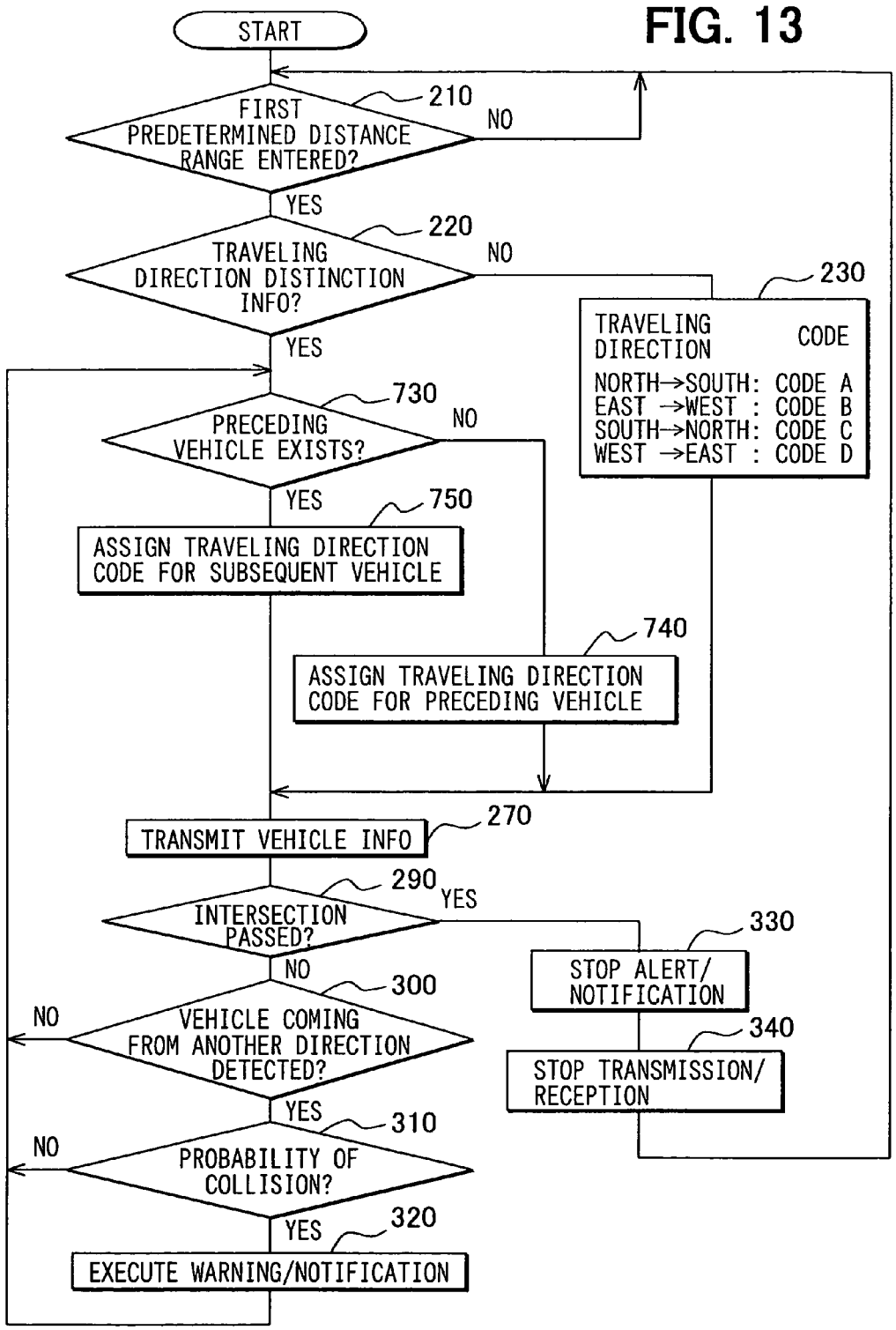
FIG. 13
START
FIRST PREDETERMINED DISTANCE RANGE ENTERED?
210
NO
YES
TRAVELING DIRECTION DISTINCTION INFO?
220
NO
YES
230
TRAVELING DIRECTION
CODE
NORTH→SOUTH: CODE A
EAST →WEST : CODE B
SOUTH→NORTH: CODE C
WEST →EAST : CODE D
PRECEDING VEHICLE EXISTS?
730
NO
YES
ASSIGN TRAVELING DIRECTION CODE FOR SUBSEQUENT VEHICLE
750
ASSIGN TRAVELING DIRECTION CODE FOR PRECEDING VEHICLE
740
TRANSMIT VEHICLE INFO
270
INTERSECTION PASSED?
290
YES
NO
STOP ALERT/ NOTIFICATION
330
STOP TRANSMISSION/ RECEPTION
340
VEHICLE COMING FROM ANOTHER DIRECTION DETECTED?
300
NO
YES
PROBABILITY OF COLLISION?
310
NO
YES
EXECUTE WARNING/NOTIFICATION
320

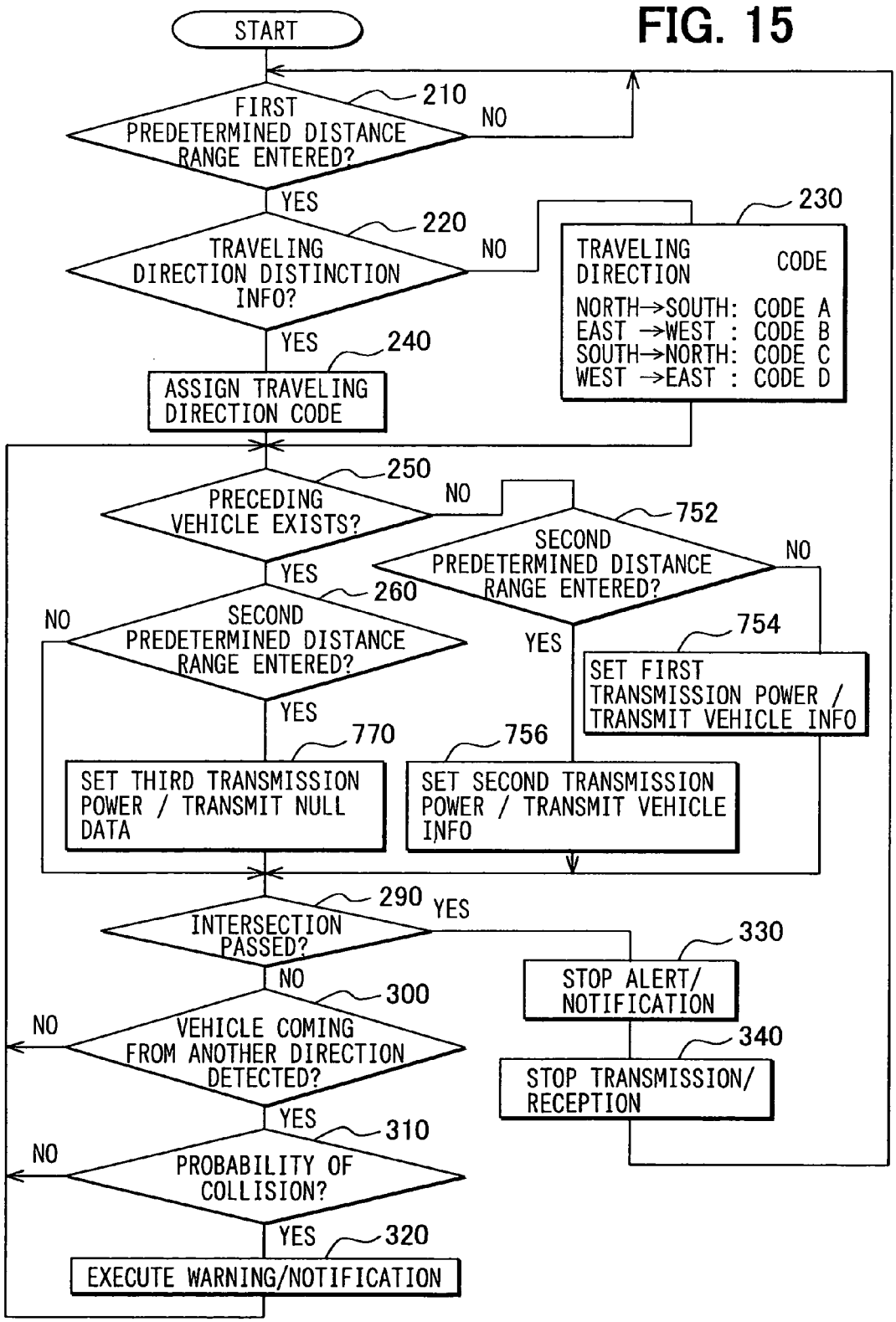
FIG. 15
START
FIRST PREDETERMINED DISTANCE RANGE ENTERED?
210
NO
YES
TRAVELING DIRECTION DISTINCTION INFO?
220
NO
YES
230
TRAVELING DIRECTION CODE
NORTH→SOUTH: CODE A
EAST →WEST : CODE B
SOUTH→NORTH: CODE C
WEST →EAST : CODE D
240
ASSIGN TRAVELING DIRECTION CODE
250
PRECEDING VEHICLE EXISTS?
NO
752
SECOND PREDETERMINED DISTANCE RANGE ENTERED?
NO
YES
260
SECOND PREDETERMINED DISTANCE RANGE ENTERED?
NO
YES
754
SET FIRST TRANSMISSION POWER / TRANSMIT VEHICLE INFO
YES
770
SET THIRD TRANSMISSION POWER / TRANSMIT NULL DATA
756
SET SECOND TRANSMISSION POWER / TRANSMIT VEHICLE INFO
290
INTERSECTION PASSED?
YES
330
STOP ALERT/ NOTIFICATION
NO
300
VEHICLE COMING FROM ANOTHER DIRECTION DETECTED?
NO
340
STOP TRANSMISSION/ RECEPTION
YES
310
PROBABILITY OF COLLISION?
NO
YES
320
EXECUTE WARNING/NOTIFICATION

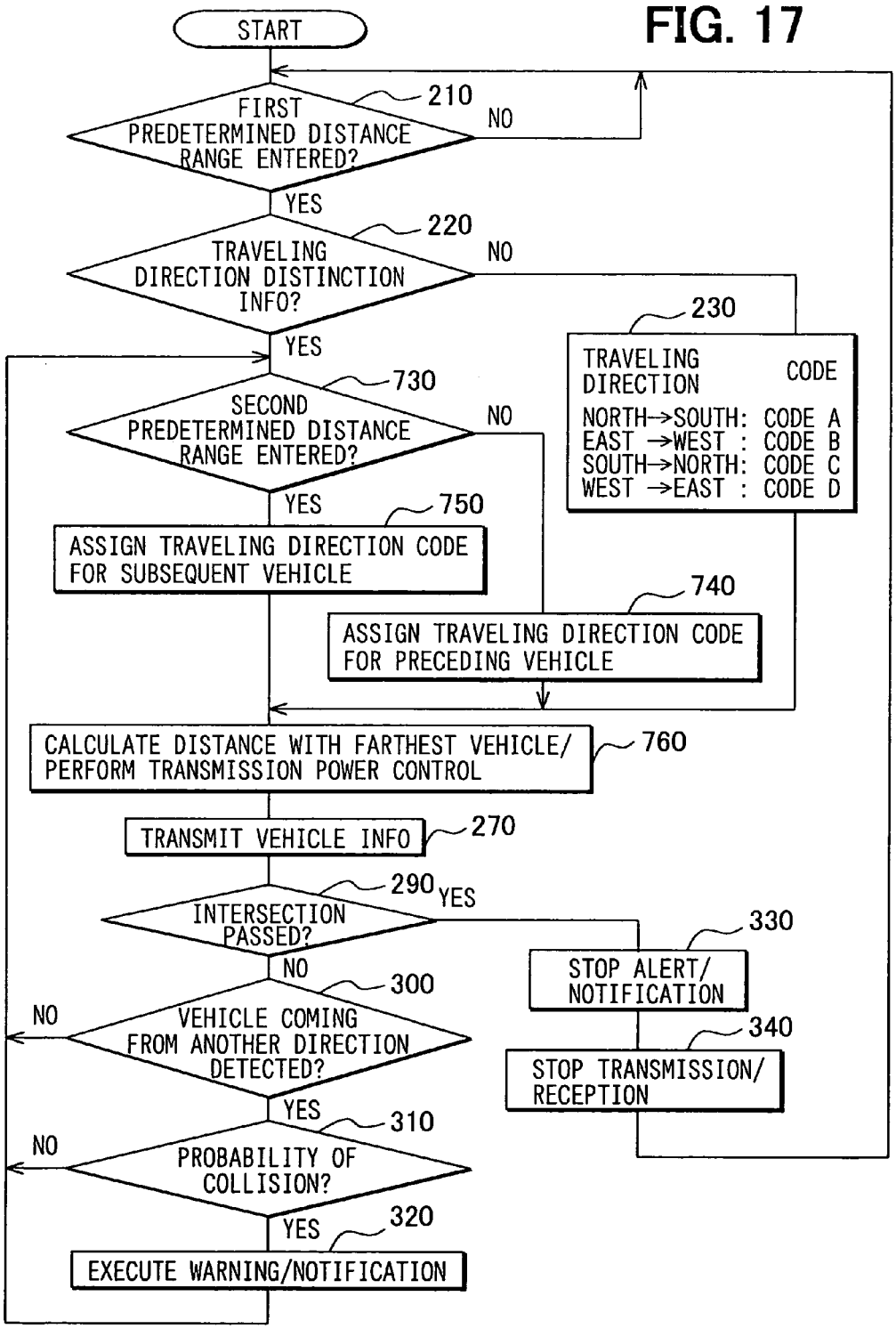
FIG. 17
START
FIRST PREDETERMINED DISTANCE RANGE ENTERED?
210
NO
YES
TRAVELING DIRECTION DISTINCTION INFO?
220
NO
YES
230
TRAVELING DIRECTION CODE
NORTH→SOUTH: CODE A
EAST →WEST : CODE B
SOUTH→NORTH: CODE C
WEST →EAST : CODE D
SECOND PREDETERMINED DISTANCE RANGE ENTERED?
730
NO
YES
ASSIGN TRAVELING DIRECTION CODE FOR SUBSEQUENT VEHICLE
750
ASSIGN TRAVELING DIRECTION CODE FOR PRECEDING VEHICLE
740
CALCULATE DISTANCE WITH FARTHEST VEHICLE/ PERFORM TRANSMISSION POWER CONTROL
760
TRANSMIT VEHICLE INFO
270
INTERSECTION PASSED?
290
YES
NO
STOP ALERT/ NOTIFICATION
330
STOP TRANSMISSION/ RECEPTION
340
VEHICLE COMING FROM ANOTHER DIRECTION DETECTED?
300
NO
YES
PROBABILITY OF COLLISION?
310
NO
YES
EXECUTE WARNING/NOTIFICATION
320

IN-VEHICLE RADIO APPARATUS

CROSS REFERENCE TO RELATED APPLICATIONS

This application is based on and incorporates herein by reference Japanese Patent Applications No. 2004-14364 filed on Jan. 22, 2004, and No. 2004-320591 filed on Nov. 4, 2004.

FIELD OF THE INVENTION

The present invention relates to an in-vehicle apparatus to perform radio transmission upon entrance of a vehicle to an intersection.

BACKGROUND OF THE INVENTION

In recent years, a system for preventing vehicles from bumping into each other and protecting pedestrians from vehicles by using vehicle roadside communication and inter-vehicle communication has been studied. For example, Patent Document 1 and Patent Document 2 disclose a technique for providing a collision prevention system premised on use of the vehicle roadside communication. Further, Patent Document 3 discloses a technique for avoiding collision between vehicles by notifying positional information of a vehicle from an in-vehicle radio apparatus to another vehicle.

Patent Document 1: JP-2000-339591A

Patent Document 2: JP-2001-126193A (U.S. Pat. No. 6,337,637 B1)

Patent Document 3: JP-2002-260194A

However, in the above-described conventional techniques, when in-vehicle radio apparatuses in multiple vehicles radio-transmit vehicle information simultaneously, the transmission waves interfere with each other, which disturbs information transmission to other vehicles.

SUMMARY OF THE INVENTION

In view of the above problems, it is an object of the present invention to provide an in-vehicle radio apparatus to radio-transmit information from a vehicle which is to enter an intersection, which suppresses the interference between a radio signal transmitted from the vehicle and a radio signal transmitted from another vehicle.

A first characteristic feature of the present invention to attain the above object is that the in-vehicle radio apparatus allocates a communication channel corresponding to a traveling direction of the vehicle as a communication channel used for transmission by a transmission unit.

In this arrangement, the in-vehicle radio apparatus to radio-transmit information from a vehicle which is to enter an intersection allocates a communication channel corresponding to a traveling direction of the vehicle, and performs radio transmission by using the allocated communication channel. Accordingly, as a different communication channel is allocated to another vehicle which enters the intersection from a different direction, the interference between the radio signal transmitted from the vehicle and the radio signal transmitted from the other vehicle can be suppressed. Further, as information is transmitted in a communication channel allocated to a direction, the direction for entrance to an intersection can be specified based on the type of received communication channel. Thus the approach direction of the vehicle can be correctly transmitted.

Note that as the communication channel, an FDMA (Frequency Division Multiple Access) frequency, a TDMA (Time Division Multiple Access) time slot, a spread code in a spread spectrum system, an OFDM (Orthogonal Frequency Division Multiplexing) orthogonal frequency or the like may be used.

Further, a second characteristic feature of the present invention is that it is determined that the vehicle has approached to a first distance from the intersection, and based on the determination, the communication channel corresponding to the approach direction of the vehicle to the intersection is allocated as a communication channel used for transmission by the transmission unit.

In this arrangement, transmission can be performed when the vehicle has approached an intersection.

Further, a third characteristic feature of the present invention is that the communication channel corresponding to the approach direction of the vehicle to the intersection is specified based on correspondence data between an approach direction to a particular intersection and the communication channel.

It is possible to perform flexible communication channel allocation by intersection by using this correspondence data.

Further, a fourth characteristic feature of the present invention is that the apparatus further comprises a preceding vehicle detection unit for detecting existence of a preceding vehicle between the intersection and the vehicle, which performs transmission of a radio signal in a communication channel corresponding to the approach direction of the vehicle to the intersection, and a transmission prohibition unit for, based on detection, prohibiting transmission by the transmission unit with the allocated communication channel.

In this arrangement, as interference with a signal transmitted from the preceding vehicle which is to enter from the same direction as that of the vehicle is not caused, the interference between the radio signal transmitted from the vehicle and the radio signal transmitted from the other vehicle can be suppressed.

Further, a fifth characteristic feature of the present invention is that the apparatus further comprises a second approach determination unit for determining that the vehicle has approached a second distance shorter than the first distance from the intersection, and a null data transmission control unit for, based on determination by the second approach determination unit, causing the transmission unit to transmit null data in the communication channel allocated by the allocation unit, regardless of the transmission prohibition unit.

In this arrangement, as interference with a signal transmitted from the preceding vehicle which is to enter from the same direction as that of the vehicle is not caused by transmission of null data, the interference between the radio signal transmitted from the vehicle and the radio signal transmitted from the other vehicle can be suppressed. Further, as transmission itself is performed, the existence of the vehicle can be recognized by other vehicles.

Further, a sixth characteristic feature of the present invention is that regarding a five-forked or more-forked intersection, the correspondence data has five or more communication channels corresponding to approach directions to the intersection.

Further, a seventh characteristic feature of the present invention is that regarding closely continuous intersections, the correspondence data has communication channels, corresponding to adjacent intersections, not to overlap with each other.

Further, an eighth characteristic feature of the present invention is that it is determined that the vehicle has approached the first distance from an intersection without traffic signal, and based on the determination, a communication channel corresponding to an approach direction of the vehicle to the intersection is allocated as a communication channel used for transmission by the transmission unit.

Further, a ninth characteristic feature of the present invention is that it is determined that the vehicle has approached the first distance from an intersection around which a building exists, and based on the determination, a communication channel corresponding to an approach direction of the vehicle to the intersection is allocated as a communication channel used for transmission by the transmission unit.

Further, a tenth characteristic feature of the present invention is that the apparatus further comprises a unit for determining whether or not a current position is included in map data, and if the current position is not included in the map data, the transmission unit is caused to always perform transmission by using the communication channel allocated by the allocation unit.

Further, an eleventh characteristic feature of the present invention is that reception of radio signal is tried in a communication channel corresponding to an approach direction different from the approach direction of the vehicle to the intersection by using a reception unit.

Further, a twelfth characteristic feature of the present invention is that in a case where the radio signal has been received in the communication channel by trial of reception, it is determined whether or not there is a probability of collision for the vehicle at the intersection based on the received signal, and if there is a probability of collision, the probability is notified.

This arrangement contributes to avoidance of collision at an intersection based on information from another vehicle.

Further, a twelfth characteristic feature of the present invention is that in the correspondence data, regarding continuous multiple intersections, the same communication channel corresponds to a direction continuously passing the multiple intersections along a road.

Further, a thirteenth characteristic feature of the present invention is that the communication channel corresponding to the approach direction of the vehicle to the intersection is specified based on a traveling direction of the vehicle and correspondence data between an approach direction to an intersection and the communication channel by geographical division.

It is possible to perform flexible communication channel allocation by geographical division by using this correspondence data.

Further, a fourteenth characteristic feature of the present invention is that based on detection of existence of a preceding vehicle between the intersection and the vehicle, which performs transmission of radio signal in a communication channel corresponding to the approach direction of the vehicle to the intersection, transmission in the allocated communication channel is performed at a timing different from a timing of transmission in the preceding vehicle.

In this arrangement, as interference with a signal transmitted from the preceding vehicle which is to enter from the same direction as that of the vehicle is not caused, the interference between the radio signal transmitted from the vehicle and the radio signal transmitted from the other vehicle can be suppressed.

Further, a fifteenth characteristic feature of the present invention is that transmission power is controlled to be reduced as the distance between the vehicle and the intersection becomes shorter.

Further, a sixteenth characteristic of the present invention is that transmission power of the transmission unit is reduced based on determination that the vehicle has approached a second distance shorter than the first distance from the intersection.

Further, a seventeenth characteristic of the present invention is that the transmitted signal includes position data of the vehicle specified by a navigation apparatus by using map matching.

In this arrangement, accurate information on a road where the vehicle is positioned can be transmitted.

Further, an eighteenth characteristic feature of the present invention is that in the correspondence data, a communication channel in a particular approach direction to a particular intersection corresponds to a transmission end position of the communication channel, and when the transmission unit transmits a radio signal in a communication channel allocated by the allocation unit regarding an approach direction to an intersection, the in-vehicle radio apparatus terminates transmission in the communication channel based on passage of the vehicle across a transmission end position corresponding to the communication channel for the approach direction to the intersection of the correspondence data.

In this arrangement, flexible transmission end position can be controlled.

Further, a nineteenth characteristic feature of the present invention is that in the correspondence data, regarding continuous multiple intersections, the same communication channel corresponds to a direction continuously passing the multiple intersections along a road, and a transmission end position corresponding to the same communication channel is a position of the last intersection upon passing of the continuous multiple intersections along the road.

In this arrangement, while transmission is performed in the same communication channel through the continuous multiple intersections, the transmission can be maintained.

Further, a twentieth characteristic feature of the present invention is that in the correspondence data, multiple communication channels correspond to a particular approach direction to an intersection, and based on detection of existence of a preceding vehicle between the intersection and the vehicle, which performs transmission of a radio signal in a communication channel corresponding to the approach direction of the vehicle to the intersection, the in-vehicle radio apparatus allocates a communication channel different from the communication channel used for transmission in the preceding vehicle, among communication channels in the correspondence data corresponding to the approach direction of the vehicle to the intersection, as a code used for transmission by the transmission unit.

In this arrangement, as interference with a signal transmitted from the preceding vehicle which is to enter from the same direction as that of the vehicle is not caused, the interference between the radio signal transmitted from the vehicle and the radio signal transmitted from the other vehicle can be suppressed.

Further, a twenty-first characteristic feature of the present invention is that transmission power is controlled based on a distance between a position of a vehicle as a transmission originator included as data in the signal received with a spread code corresponding to an approach direction different from the approach direction of the vehicle to the intersection and a position of the vehicle.

In this arrangement, power control can be performed based on a relative distance to a vehicle of the transmission originator.

BRIEF DESCRIPTION OF THE DRAWINGS

The above and other objects, features, and advantages of the present invention will become more apparent from the following detailed description made with reference to the accompanying drawings. In the drawings:

FIG. 2 is a flowchart of a program executed by a CPU according to the first embodiment;

FIG. 10 is a flowchart of a program executed by the CPU according to the second embodiment;

FIG. 11 is a flowchart of a program executed by the CPU according to a third embodiment;

FIG. 13 is a flowchart of a program executed by the CPU according to a fourth embodiment;

FIG. 15 is a flowchart of a program executed by the CPU according to a fifth embodiment;

FIG. 17 is a flowchart of a program executed by the CPU according to a sixth embodiment;

DETAILED DESCRIPTION OF THE PREFERRED EMBODIMENTS

First Embodiment

Figure 1:
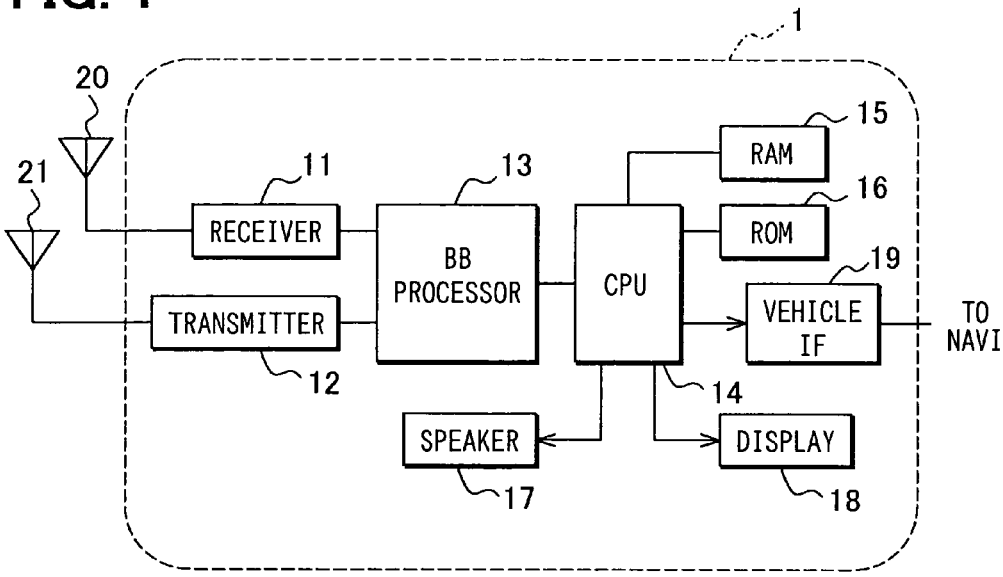
FIG. 1 is a block diagram showing a construction of a radio apparatus according to a first embodiment of the present invention.

Hereinbelow, a first embodiment of the present invention will be described. FIG. 1 shows a hardware construction of a radio apparatus 1 for inter-vehicle communication using a CDMA (Code Division Multiple Access) method according to the present embodiment.

The radio apparatus 1 is provided in a vehicle. When the vehicle (hereinbelow, also referred to as a "subject vehicle") enters an intersection without traffic signal, around which a building exists, the radio apparatus 1 transmits vehicle information indicating the position, speed and the like of the vehicle to other vehicles by using a spread code allocated to an approach direction of the vehicle to the intersection. Further, the radio apparatus 1 receives a signal transmitted from another vehicle by using a spread code allocated another road crossing the intersection, and based on vehicle information included in the received signal, actuates warning or the like for avoidance of collision.

The radio apparatus 1 has a receiver 11, a transmitter 12, a baseband processor 13, a CPU 14, a RAM 15, a ROM 16, a speaker 17, a display 18, a vehicle interface circuit 19, a reception antenna 20, and a transmission antenna 21.

The receiver 11 performs amplification, frequency conversion, demodulation, A/D conversion, and the like on a signal received by the reception antenna 20, and outputs the result of processing to the baseband processor 13.

The transmitter 12 performs D/A conversion, modulation, frequency conversion, amplification, and the like on data inputted from the baseband processor 13, and outputs the result of processing to the transmission antenna 21.

The baseband processor 13, comprising, e.g., an FPGA (Field Programmable Gate Array) having a programmable circuit construction, performs processing based on the programmed circuit construction on a signal inputted from the receiver 11, and outputs data resulted from the processing to the CPU 14. Further, the baseband processor 13 performs processing based on the programmed circuit construction on data received from the CPU 14, and outputs data resulted from the processing to the transmitter 12. More particularly, the baseband processor 13 receives a signal designating a spread code for CDMA transmission and a spread code for CDMA reception from the CPU 14, spread-modulates data received from the CPU 14 with the designated transmission spread code, and outputs the modulated data to the transmitter 12. Further, the baseband processor 13 demodulates data received from the receiver 11 with the designated reception spread code and outputs the demodulated data to the CPU 14. Note that the receiver 11, the transmitter 12, and the baseband processor 13 correspond to a transmission unit and a reception. The speaker 17 outputs a sound based on a sound signal received from the CPU 14.

The display 18 displays a video image based on a video signal received from the CPU 14 on a display screen such as a liquid crystal display.

The vehicle interface circuit 19 receives data transmitted from a car navigation apparatus in the vehicle via an in-vehicle LAN (not shown), converts the data to a format recognizable for the CPU 14 and outputs the data to the CPU 14. Further, the vehicle interface circuit 19 processes data for the car navigation apparatus, received from the CPU 14, to a format appropriate to a communication protocol of the in-vehicle LAN, and outputs the processed data to the car navigation apparatus via the in-vehicle LAN.

Note that the above-described car navigation apparatus has map data including positional information on roads, intersections, traffic signals, buildings and the like in its storage medium. The car navigation apparatus specifies a current position of the vehicle by using well-known devices and techniques such as a GPS receiver, a vehicle speed sensor, a gyroscope and a map matching technique. The map data has traveling direction distinction information. The traveling direction distinction information indicates correspondence between approach directions and CDMA spread codes by each intersection, as correspondence data between an approach direction to a particular intersection and the spread code. Particular examples of correspondence between an approach direction to an intersection and a spread code will be described later.

Further, the car navigation apparatus returns information on an intersection and the distance from the vehicle to the intersection, data on current position, traveling direction, running speed and the like of the vehicle, based on a command included in a signal received via the in-vehicle LAN, to an originator of the command, via the in-vehicle LAN.

The CPU 14 reads a program from the ROM 16 and executes the program, operates based on the contents of processing described in the program, and in the operation, appropriately reads information from the RAM 15 and the ROM 16, and writes information into the RAM 13. Further, when the CPU 14 is on, the CPU 14 performs communication with an radio apparatus of another vehicle by outputting data for the radio apparatus of the other vehicle to the baseband processor 13, and receiving data transmitted from the radio apparatus of the other vehicle from the baseband processor 13. Further, when the CPU 14 is on, the CPU 14 performs data transmission/reception with the car navigation apparatus in accordance with necessity by using the vehicle interface circuit 19 by outputting data for the car navigation apparatus to the vehicle interface circuit 19, and receiving data transmitted from the car navigation apparatus from the vehicle interface circuit 19.

FIG. 2 is a flowchart showing a program read from the ROM 16 and executed by the CPU 14 in a case where the radio apparatus 1 having the above construction is provided in the vehicle.

First, at Step 210, determination as to whether or not the vehicle has entered a first predetermined distance range from an intersection is repeated until it is determined that the vehicle has entered the distance range. Note that the intersection at this step means an intersection without traffic signal, around which a building exists. The building means a visibility-reducing structure which blocks the view from a vehicle which is to enter the intersection from another road. Further, more specifically, the building is a structure around the intersection positioned between a road on which the vehicle is currently approaching the intersection and a road intersecting the above road.

The determination as to whether or not the vehicle is approaching the intersection is made based on information from the car navigation apparatus, on the position (latitude and longitude) of the vehicle, the position of the intersection which the subject vehicle is to enter, whether or not the intersection has a traffic signal, and whether or not a building exists around the intersection. The information from the car navigation apparatus is received by transmitting a command to return the information to the car navigation apparatus by using the vehicle interface circuit 19. Note that the predetermined distance is, for example, 100 meters.

If it is determined that the vehicle has entered the predetermined distance range from an intersection as described above, it is determined at Step 220 whether or not the traveling direction distinction information regarding the intersection that the vehicle is to pass is stored in the map data. More particularly, a command requesting the traveling direction distinction information regarding the intersection is transmitted to the car navigation apparatus. If the traveling direction distinction information has been returned, it is determined as affirmative, while if the traveling direction distinction information has not returned within a predetermined period, or if an error message indicating absence of the data or the like has been returned, it is determined as negative. If it is determined as affirmative, Step 240 is performed, while if it is determined as negative, Step 230 is performed.

At Step 230, a spread code previously set corresponding to the approach direction of the vehicle is allocated as a spread code used for transmission. The previously-set data is stored in the ROM 16. Note that information on the traveling direction of the vehicle, specified by the car navigation apparatus by using the gyroscope, the GPS receiver and the like, can be obtained by transmitting a command requesting the information on the traveling direction of the vehicle to the car navigation apparatus.

Figure 3:
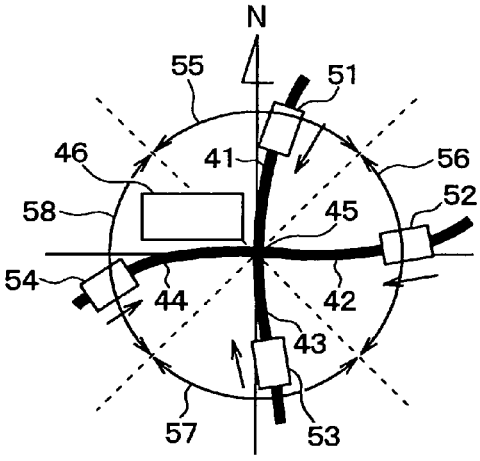
FIG. 3 is an explanatory view of correspondence between approach directions and spread codes according to the first embodiment.

FIG. 3 is an explanatory view of an example of correspondence between previously-set approach directions and spread codes (allocation). This figure is an overhead view of roads where the upper side corresponds to a northward direction. In the figure, roads 41 to 44 are roads to enter an intersection 45. Further, a building 46 exists between the road 41 and the road 44 near the intersection 45. Vehicles 51 to 54 respectively having the radio apparatus 1 are traveling on the roads 41 to 44 toward the intersection 45. One of spread code A, spread code B, spread code C, spread code D and spread code D is allocated to the radio apparatus 1 of the vehicles 51 to 54. The approach directions to the intersection 45 are classified as four directions, north→south direction, east→west direction, south→north direction and west→east direction. If the traveling direction of the vehicle belongs to the north→south direction, the spread code A is allocated; if the traveling direction belongs to the east→west direction, the spread code B is allocated; if the traveling direction belongs to the south→north direction, the spread code C is allocated; and if the traveling direction belongs to the west→east direction, the spread code D is allocated. In FIG. 3, the north→south directional range is a directional range 55 having spread of 90° with a direction entering the intersection 45 from true north as a center; the east→west directional range is a directional range 56 having spread of 90° with a direction entering the intersection 45 from true east as a center; the south→north directional range is a directional range 57 having spread of 90° with a direction entering the intersection 45 from true south as a center; and the west→east directional range is a directional range 58 having spread of 90° with a direction entering the intersection 45 from true west as a center. Accordingly, in the example of FIG. 3, the spread code A is allocated to the vehicle 51; the spread B, to the vehicle 52; the spread code C, to the vehicle 53; and the spread code D, to the vehicle 54, as transmission spread codes.

At Step 240, a spread code for transmission is allocated in accordance with the traveling direction distinction information received from the car navigation apparatus at Step 220. The traveling direction distinction information includes information on traveling direction ranges to the intersection and transmission codes allocated to the respective directional ranges. At Step 240, the directional range included in the information, to which the traveling direction of the vehicle belongs to, is specified, and further, the spread code allocated to the directional range in the information is specified. The specified spread code is allocated as a spread code for transmission.

The determination of directional range and allocation of spread code based on the traveling direction distinction information may be made by, as in the case of Step 230, classifying approach directions as four directional ranges and allocating spread codes A to D to the respective directional ranges, or the allocation may be made based on the number of roads to enter an intersection as the subjects of allocation. For example, regarding a four-forked intersection, approach directions are classified to four directional ranges, or regarding a five-forked intersection, approach directions are classified to five directional ranges, and different spread codes are allocated to the directional ranges. In this arrangement, flexible spread code allocation can be performed in correspondence with conditions of each intersection.

Figure 4:
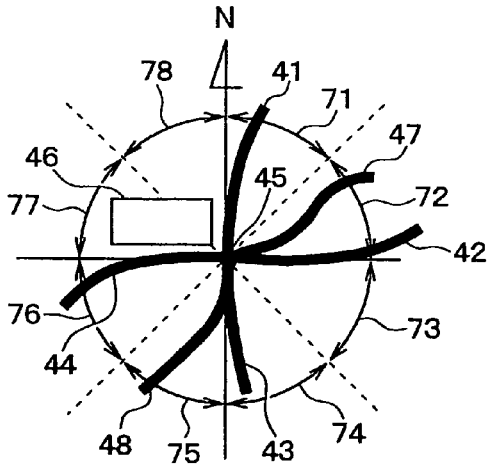
FIG. 4 is an example of spread code allocation in a six-forked intersection 45 according to the first embodiment.

FIG. 4 shows an example of spread code allocation in a six-forked intersection 45 to which six roads 41 to 46 are connected. In the traveling direction distinction information, as allocation regarding this intersection, approach directions to the intersection 45 are classified to eight directional ranges 71 to 78, and different eight spread code A, spread code B, spread code C, spread code D, spread code E, spread code F, spread code G and spread code H are allocated to the respective directional ranges.

Figure 5:
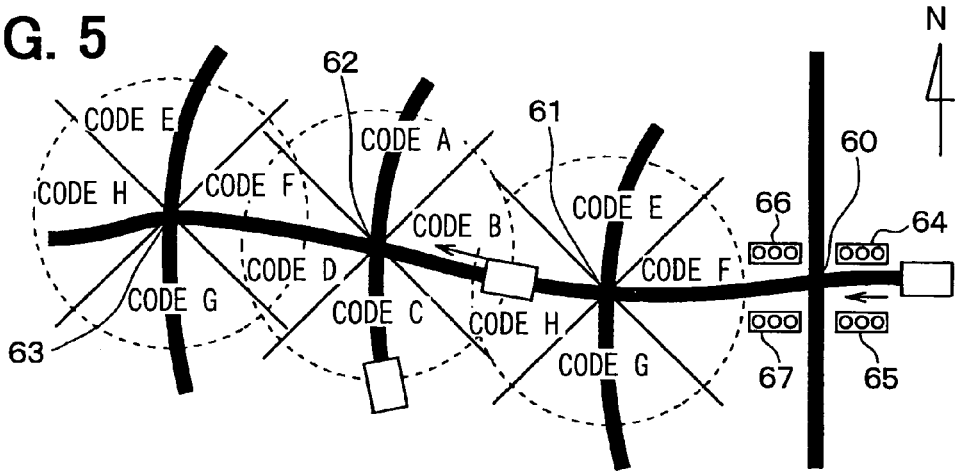
FIG. 5 is an example of spread code allocation in the six-forked intersection 45 where six roads are interconnected according to the first embodiment.

Further, as allocation of spread codes to directional ranges by the traveling direction distinction information, it may be arranged such that regarding closely continuous intersections each having no traffic signal and a near visibility-reducing building, spread codes, corresponding to the respective intersections, are allocated not so as to overlap with each other, to adjacent intersections. Note that the two closely continuous intersections means that two intersections within the same range of transmission radio wave from one radio apparatus 1. A particular distance between the two intersections is e.g., within 200 m. Further, spread codes not to overlap with each other means spread codes not corresponding with each other allocated to adjacent two intersections. FIG. 5 shows an example of spread code allocation in this case.

In FIG. 5, four intersections 60 to 63 are closely continuous intersections. Note that the intersections 61 to 63 have no traffic signal. A visibility-reducing building exists around these intersections 61 to 63. In this case, in the traveling direction distinction information, the respective approach directions to the intersections 61 to 63 are classified to four directional ranges. Spread code E, spread code F, spread code G and spread code H are allocated to the directional ranges of the intersection 61; spread code A, spread code B, spread code C and spread code D, to the directional ranges of the intersection 62; and spread code E, spread code F, spread code G and spread code H, to the directional ranges of the intersection 63 as in the case of intersection 61.

Following Step 230 or Step 240, at Step 250, it is determined whether or not a preceding vehicle which transmits vehicle information in the same traveling direction as that of the subject vehicle exists. More particularly, a signal is outputted to the baseband processor 13 to use the transmission spread code allocated at Step 230 or Step 240 for reception, to try reception of signal with the spread code by using the baseband processor 13. If vehicle information with the spread code has been received, it is determined that a preceding vehicle which transmits vehicle information in the same traveling direction of the subject vehicle exists. In contrast, if vehicle information has not been received for a predetermined period, it is determined that there is no preceding vehicle which transmits vehicle information in the same traveling direction as that of the subject vehicle.

Note that there is a case where vehicle information is received with the spread code from a direction behind the vehicle, as determination as to whether or not a preceding vehicle which transmits vehicle information in the same traveling direction as that of the subject vehicle. To handle this case, the following may be arranged even if vehicle information has been received with the spread code. Namely, the current position of transmission originator vehicle included in the vehicle information is compared with the current position of the subject vehicle obtained by a request command to the car navigation apparatus. Only if the current position of the transmission originator vehicle is consequently closer to the intersection than the current position of the subject vehicle, it is determined that a preceding vehicle which transmits vehicle information in the same traveling direction as that of the subject vehicle. Further, it may be arranged such that the CPU 14 transmits a command signal to perform comparison between the current position of the transmission originator vehicle and the current position of the subject, to the car navigation apparatus. Then the car navigation apparatus compares the received current position of the transmission originator vehicle with the current position of the vehicle specified by the car navigation apparatus itself, to determine which position is closer to the intersection, and outputs the result of comparison to the CPU 14.

Further, it may be arranged such that the reception antenna 20 has directivity not to receive a signal from behind.

If it is determined as affirmative at Step 250, processing at Step 260 is performed, and if it is determined as negative, processing at Step 270 is performed.

At Step 270 in a case where there is no preceding vehicle which transmits vehicle information in the same traveling direction as that of the subject vehicle, vehicle information on the position, running speed, traveling direction and the like of the vehicle is transmitted with the spread code allocated at Step 230 or Step 240. More particularly, a signal is outputted to the baseband processor 13 to use the transmission spread code allocated at Step 230 or Step 240 for transmission, then the vehicle information is transmitted by using the baseband processor 13 and the transmitter 12. Following Step 270, processing at Step 290 is performed.

Note that the positional information of the vehicle transmitted here was specified by the car navigation apparatus by using map matching or the like as described above. As the positional information as a result of map matching is transmitted, more accurate information on the road where the vehicle runs can be transmitted.

At Step 260 in a case where a preceding vehicle which transmits vehicle information in the same traveling direction as that of the subject vehicle exists, it is determined whether or not the vehicle has entered a second predetermined distance range from the intersection. The determination is made by a similar way to that at Step 210. The second predetermined distance is shorter than the first predetermined distance, and is, e.g., 50 meters. If it is determined that the vehicle has entered the second predetermined distance range at Step 260, processing at Step 280 is performed, while if it is determined that the vehicle has not entered the second predetermined distance range, processing at Step 290 is performed.

Figure 6:
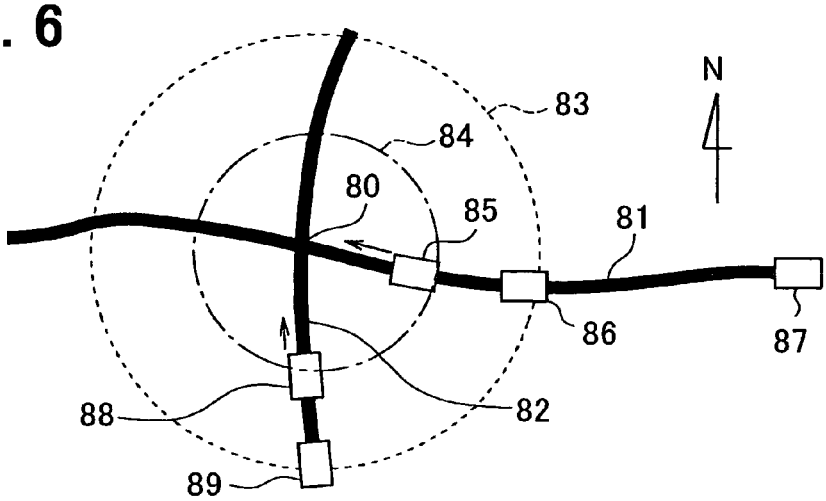
FIG. 6 is an explanatory view of relation between a first predetermined distance and a second predetermined distance according to the first embodiment.

FIG. 6 is an explanatory view of relation between the first predetermined distance and the second predetermined distance. In this figure, vehicles 85 and 86 run in this order on a road 81 to enter an intersection 80, and vehicles 88 and 89 run in this order on a road 82 to enter the intersection 80. A circle 83 has a radius corresponding to the first predetermined distance, and a circle 84 has a radius corresponding to the second predetermined distance. For example, the radio apparatus 1 provided in the vehicle 86, which has entered within the first predetermined distance range from the intersection 80, detects that the radio apparatus 1 of the preceding vehicle 85 transmits vehicle information with the same transmission code. As the vehicle 86 has not entered the predetermined second distance range from the intersection 80, the CPU 14 of the radio apparatus 1 proceeds from Step 260 to processing to Step 290.

At Step 280, null data is transmitted with the spread code allocated for transmission. More particularly, all-zero data is outputted as transmission data to the baseband processor 13, and an exclusive or (XOR) between the zero data and the transmission spread code is transmitted by using the baseband processor 13 and the transmitter 12. The transmitted radio wave signal, which even overlaps a transmission signal with the same spread code including vehicle information, does not disturb reception of the vehicle information. Following Step 280, the processing at Step 290 is performed.

At Step 290, it is determined whether or not the vehicle has passed the intersection. That is, it is determined whether or not the vehicle has passed the intersection based on the current position of the vehicle obtained by transmitting the request command to the car navigation apparatus, the current position of the intersection determined at Step 210 that the vehicle has entered, and if necessary, the traveling direction of the vehicle. If it is determined that the vehicle has passed the intersection, processing at Step 330 is performed, while if it is determined that the vehicle has not passed the intersection, processing at Step 300 is performed.

At Step 300, it is determined whether or not the existence of another vehicle incoming from another direction has been detected. More particularly, a signal to use a spread code allocated to another approach directional range as a spread code for reception is outputted to the baseband processor 13, and it is determined whether or not a signal with the spread code has been received by using the baseband processor 13. If the existence of another vehicle has been detected, processing at Step 310 is performed, while if the existence of another vehicle has not been detected, the processing at Step 250 is performed.

At Step 310, it is determined whether or not there is a probability of collision with the other vehicle. More particularly, it is determined whether or not the risk of collision between the vehicle and the other vehicle is at or higher than a predetermined level from information on current position, vehicle speed and the like in the vehicle information included in the signal from the other vehicle received at Step 300, the information on the running speed, the current position and the like of the subject vehicle, and the information on the approach direction corresponding to the spread code used for the signal reception.

If there is a probability of collision, warning and notification are performed at Step 320. More particularly, a warning sound is outputted from the speaker 17, and a warning video image is displayed on the display 18.

If there is no probability of collision at Step 310, and following Step 320, the processing at Step 250 is performed.

Further, at Step 330 following the case where it is determined at Step 290 that the vehicle has passed the intersection, the warning and notification at Step 320, if performed, are stopped.

Next, at Step 340, transmission/reception are terminated. More particularly, actuation of the receiver 11, the transmitter 12 and the baseband processor 13 is stopped. Following Step 340, again the processing at Step 210 is performed.

In this manner, when the vehicle has passed the intersection, the transmission/reception with the spread code allocated by that time are terminated, and the processing at Step 210 is repeated until the vehicle approaches the next intersection.

As the CPU 14 executes the program as above, every time when the vehicle enters the first distance range from an intersection without traffic signal, around which a visibility-reducing building exists (See Step 210), the radio apparatus 1 specifies a spread code for transmission allocated to the traveling direction of the vehicle (See Steps 220, 230 and 240). If the traveling direction distinction information regarding the intersection is included in the map data stored in the storage medium of the car navigation apparatus, a spread code is specified based on the information (Step 240), while if the traveling direction distinction information is not included in the map data, a spread code is specified based on distinction information previously determined regardless of particular intersection (See Step 230).

The radio apparatus 1 appropriately repeats the processings at Steps 250, 260, 270 and 280 using the specified spread code until the vehicle passes the intersection (See Step 290). In this arrangement, when there is no preceding vehicle which transmits vehicle information in the same traveling direction as that of the subject vehicle, the vehicle information of the subject vehicle is transmitted with the spread code (corresponding to the branch from Step 250 to Step 270). Further, when there is a preceding vehicle which transmits vehicle information in the same traveling direction of the subject vehicle and the subject vehicle has not entered the second predetermined distance range from the intersection, transmission is stopped (corresponding to the branch from Step 260 to "NO"). Further, when there is a preceding vehicle which transmits vehicle information in the same traveling direction of the subject vehicle and the subject vehicle has entered the second predetermined distance range from the intersection, null data is transmitted with the spread code (corresponding to the branch from Step 260 to Step 280).

Further, the radio apparatus 1 detects an another vehicle coming from another direction to the intersection (See Step 300) by appropriately repeating the processings at Steps 300, 310 and 320. Further, if the radio apparatus 1 determines based on the vehicle information from the other vehicle that there is a probability of collision between the vehicles (See Step 310), performs warning/notification about the probability (See Step 320).

In a case where the vehicles 85 to 89 in FIG. 6 have the radio apparatus 1 which performs the above actuation, in the vehicles 85 and 88, as preceding vehicles within the first predetermined distance, vehicle information is transmitted with spread codes allocated to the respective approach directions (See Step 270 in FIG. 2). Further, in the vehicles 86 and 89 within the first predetermined distance and outside the second predetermined distance, as vehicle information is received with the allocated spread codes from the respective preceding vehicles 85 and 88, vehicle information is not transmitted (See the negative branch from Step 260 in FIG. 2).

Further, in the vehicles 85 and 86, as vehicle information transmitted from the vehicle 88 is received with a spread code other than the spread codes allocated for their transmission at the above intersection, it is detected that the vehicle 88 is coming from a direction corresponding to the spread code (See Step 300 in FIG. 2). Further, it is determined whether or not there is a probability of collision based on the vehicle information and the spread code (See Step 310). Further, in the vehicles 88 and 89, the probability of collision may also be determined based on the vehicle information transmitted from the vehicle 85.

Figure 7:
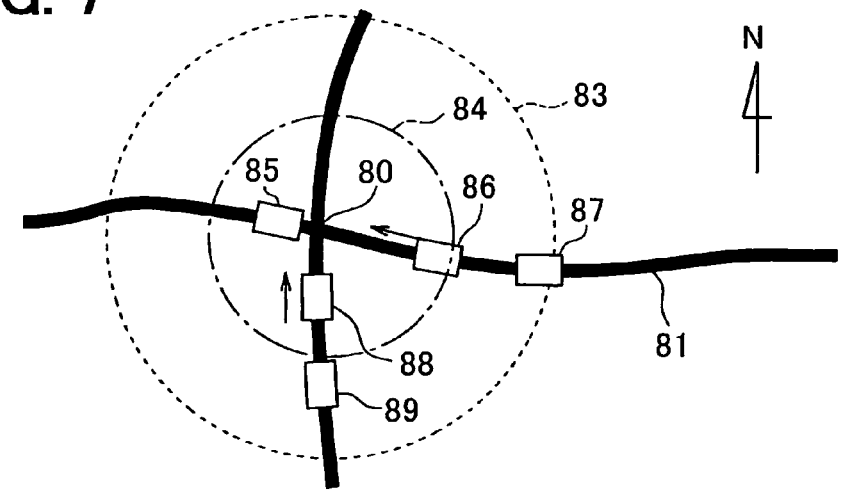
FIG. 7 is an explanatory view of disposition of vehicles at an intersection after a short elapsed time from the case of FIG. 6.

FIG. 7 is an explanatory view of disposition of vehicles 85 to 89 at an intersection 80 after a short elapsed time from the case of FIG. 6.

In this case, as the vehicle 85 has just passed the intersection 80, the transmission/reception of vehicle information is stopped (See Steps 290 and 340 in FIG. 2). The vehicle 86 thereby detects no preceding vehicle that transmits vehicle information; so that the vehicle 86 starts transmission of vehicle information with the spread code allocated for transmission.

Further, in a case where the vehicle 86 has entered the second predetermined distance range before the vehicle 85 passes the intersection 80, null data is transmitted with the spread code for transmission until the vehicle 85 has passed the intersection 80. In this arrangement, if the vehicle 85 cannot perform transmission due to some trouble, or if the time lag between the passage of the vehicle 85 across the intersection and the detection by the vehicle 86 of the passage is long, the vehicle 86 can notify its existence to the vehicles 88 and 89 although vehicle information is not transmitted from the vehicle 86.

Further, in the vehicle 87 which has newly entered the first predetermined distance, as the vehicle information from the preceding vehicle 86 is detected, vehicle information of the vehicle 87 is not transmitted.

By the above actuations, when the vehicle has entered the predetermined first distance from an intersection without traffic signal, around which a building exists, the radio apparatus 1 allocates a spread code corresponding to an approach direction of the vehicle to the intersection, and performs radio transmission by using the allocated spread code. Accordingly, as a different transmission channel is allocated to another vehicle which is coming to the intersection from a different direction, the interference between the radio signal transmitted from the vehicle and a radio signal transmitted from the other vehicle can be suppressed. Further, as the information can be transmitted with the spread code allocated to the direction, the radio apparatus 1 on the receiving side specifies the direction to enter the intersection based on the type of the received spread code, and accurately transmits the approach direction of the vehicle.

Further, the radio apparatus 1 specifies the spread code corresponding to the approach direction of the vehicle to the intersection based on correspondence data between approach directions to particular intersection and spread codes included in the map information of the car navigation apparatus. By using this data, it is possible to perform flexible allocation of spread code by intersection.

Further, when the radio apparatus 1 has detected the existence of a preceding vehicle between the intersection and the subject vehicle, and the preceding vehicle performs transmission of radio signal with the spread code corresponding to the approach direction of the subject vehicle, Step 270 is not performed so as to prohibit transmission with the spread code allocated for transmission. As interference with the signal transmitted from the preceding vehicle which enters from the same direction as that of the subject vehicle is not caused, the interference between the radio signal transmitted from the subject vehicle and the radio signal transmitted from the other vehicle can be suppressed.

Further, when it is determined that the vehicle has approached the second distance shorter than the first distance, the radio apparatus 1 transmits null data with the allocated spread code regardless of the above-described prohibition of transmission.

In this arrangement, as interference with the signal transmitted from the preceding vehicle which enters from the same direction as that of the subject vehicle is prevented by transmission of null data, the interference between the radio signal transmitted from the vehicle and the radio signal transmitted from the other vehicle can be suppressed. Further, as the transmission itself is performed, the existence of the vehicle can be recognized by the other vehicle.

Further, the radio apparatus 1 tries reception of radio signal with a spread code corresponding to an approach direction different from the approach direction of the vehicle to the intersection by performing Step 300. If a radio signal has been received with the spread code by this trial, it is determined whether or not there is a probability of collision at the intersection based on the received signal. If there is a probability of collision, the probability is notified. This arrangement contributes to avoidance of collision at an intersection based on information from another vehicle.

Second Embodiment

Next, regarding a second embodiment of the present invention, the difference from the first embodiment will be described. In the present embodiment, in the traveling direction distinction information, regarding continuous multiple intersections at standard or shorter intervals, the same spread code corresponds to a direction continuously passing the multiple intersections along a road. The standard interval here may be, e.g., 50 meters, or may be the second distance in the first embodiment.

Figures 8, 9:
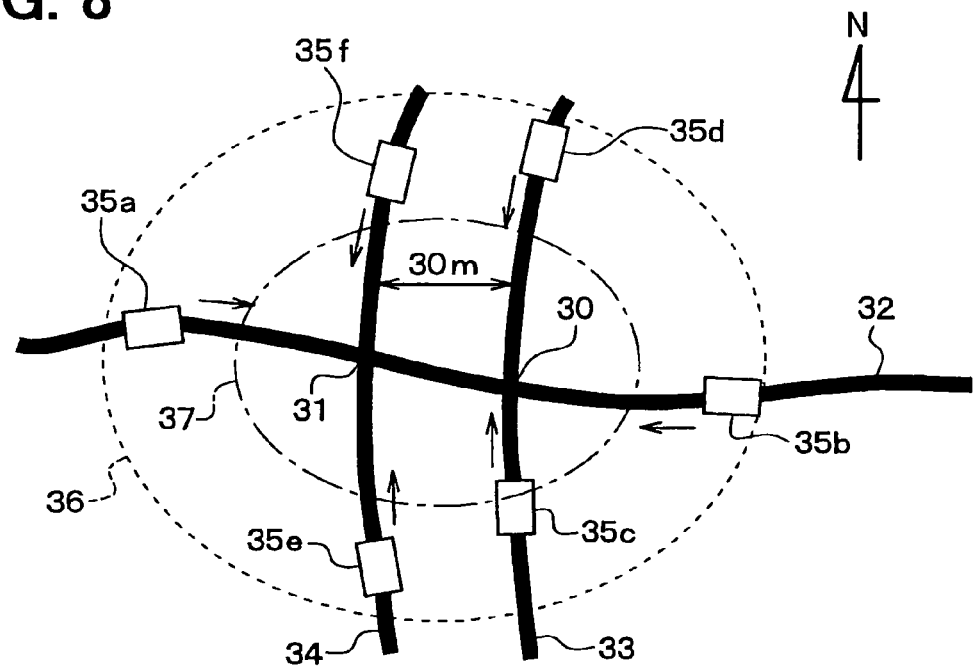
FIG. 8 is an explanatory view of roads including continuous intersections at a standard or shorter interval, according to a second embodiment.
FIG. 9 is a table of traveling direction distinction information according to the second embodiment.

FIG. 8 is an explanatory view of roads including continuous intersections 30 and 31 at a standard or shorter interval. The intersection 30 is positioned in a point where a road 32 extending east and west intersects a road 33 extending south and north. The intersection 31 is positioned in a point where the road 32 intersects a road 34 extending south and north. The distance between the intersections 30 and 31 along the road 32 (or air-line distance) is, e.g., 30 meters.

Regarding such multiple continuous intersections at standard or shorter intervals, the traveling direction distinction information is provided in the form of table as shown in FIG. 9.

That is, in the traveling direction distinction information, a spread code for transmission ("allocated code" in FIG. 9) and a transmission end position are allocated by each pair of approach direction and an intersection ("approach intersection" in FIG. 9). For example, in the case of entry south to north to the intersection 30, a spread code C is allocated as a transmission spread code and the intersection 30 is allocated as a transmission end position. Further, in the case of entry west to east to the intersection 31, a spread code D is allocated as a transmission spread code and the intersection 30 is allocated as a transmission end position.

In accordance with the allocation of this table in FIG. 9, the radio apparatus 1 of a vehicle 35*a*, which is running eastward on the road 32 to enter the intersection 31 in FIG. 8, performs transmission with the spread code D. Further, the radio apparatus 1 of a vehicle 35*b*, which is running westward on the road 32 to enter the intersection 30, performs transmission with a spread code B. Further, the radio apparatus 1 of a vehicle 35*c*, which is running northward on the road 33 to enter the intersection 30, performs transmission with the spread code C. Further, the radio apparatus 1 of a vehicle 35*d*, which is running southward on the road 33 to enter the intersection 30, performs transmission with a spread code A. Further, the radio apparatus 1 of a vehicle 35*e*, which is running northward on the road 34 to enter the intersection 31, performs transmission with a spread code F. Further, the radio apparatus 1 of a vehicle 35*f*, which is running southward on the road 34 to enter the intersection 31, performs transmission with a spread code E.

Further, the CPU 14 of the present embodiment executes a program shown in the flowchart of FIG. 10 in place of the program shown in FIG. 2. The only difference from the program in FIG. 2 is that the determination at Step 290 in FIG. 2 is replaced with determination at Step 590. At Step 590, the CPU 14 determines whether or not the vehicle has passed a designated intersection. The designated intersection means the transmission end position in the traveling direction distinction information corresponding to the intersection from the first predetermined distance range, determined at Step 210 that the vehicle has entered, and the approach direction to the intersection. More particularly, the transmission end position for the vehicle 35*a* is the intersection 30; for the vehicle 35*b*, the intersection 31; for the vehicles 35*c* and 35*d*, the intersection 30; and for the vehicles 35*e* and 35*f*, the intersection 31.

Note that the data on transmission end position may be provided only for multiple continuous intersections at standard or shorter intervals, or may be provided for other intersections.

If it is determined at Step 590 that the vehicle has passed the designated intersection, then at Step 530, processing to stop warning/notification similar to Step 330 in FIG. 2 is performed. Then at Step 540, processing to stop transmission similar to Step 340 is performed.

In this arrangement, when a vehicle holding the radio apparatus 1 has approached and entered an intersection without traffic signal, around which a visibility-reducing building exists, radio transmission from the vehicle is performed. Transmission is further continued until the vehicle has passed the transmission end position corresponding to the pair of the intersection and the approach direction in the traveling direction distinction information.

In this arrangement, in the radio apparatus 1, when the transmitter 12 transmits a radio signal with a spread code allocated based on the traveling direction distinction information regarding an approach direction to an intersection, the transmission with the spread code is terminated based on passage of the vehicle across a transmission end position in the traveling direction distinction information. Here, the transmission end position corresponds to the spread code regarding the approach direction to the intersection.

In the traveling direction distinction information, regarding continuous multiple intersections, one spread code corresponds to a direction continuously passing the multiple intersections along a road (particularly, the traveling direction eastward or westward on the road 32 in FIG. 8). Further, the end position of transmission corresponding to one spread code is the position of a last intersection upon passing of the continuous multiple intersections along the road.

For example, in FIG. 8, the radio apparatus 1 provided in the vehicle 35*a* running west to east on the road 32 continues transmission with the spread code D from a position in front of the intersection 31 until the vehicle runs out of the intersection 30. Further, the radio apparatus provided in the vehicle 35*b* running east to west on the road 32 continues transmission with the spread code B from a position in front of the intersection 30 until the vehicle runs out of the intersection 31.

In this arrangement, the transmission end position can be controlled in a flexible manner. Further, while transmission is performed in the same communication channel through the continuous multiple intersections, the radio apparatus 1 does not break the transmission. Accordingly, the risk of bumping of a vehicle into another vehicle can be reduced.

Third Embodiment

Next, regarding a third embodiment of the present invention, only the difference from the first embodiment will be described. The CPU 14 of the present embodiment executes a program shown in the flowchart of FIG. 11 in place of the program shown in FIG. 2. The difference from the flowchart in FIG. 2 is that Step 270 is replaced with Step 652, Steps 654 and 656 are added between Step 250 and Step 260, and Step 658 is added.

Upon execution of the program in FIG. 11, if it is determined at Step 250 that no preceding vehicle exists, the CPU 14 causes the transmitter 12 to transmit vehicle information of the vehicle at predetermined intervals at Step 652. For example, the transmission is continued for 20 milliseconds, then the transmission is stopped for 40 milliseconds. In this manner, the transmission is performed at predetermined intervals. This corresponds to TDMA (Time Division Multiple Access) transmission in partial periods with spread code by using a slot. Following Step 652, Step 290 is performed.

Further, if it is determined at Step 250 that a preceding vehicle exists, then at Step 654, the CPU 14 detects currently-used transmission timing. More particularly, a signal to use the transmission spread code allocated at Step 230 or 240, is outputted to the baseband processor 13, and the timing, i.e., the time slot where radio transmission is performed with the spread code, is detected from the radiowave of the spread code received by the receiver 11.

Next, at Step 656, it is determined whether or not a transmission idle slot exists. The existence of transmission idle slot means that there is a slot other than the currently-used slot detected at Step 654. If there is a transmission idle slot, Step 658 is performed, while if there is no transmission idle slot, processing similar to that of the first embodiment is performed at Step 260 and the subsequent steps.

At step 658, the vehicle information is transmitted at the idle slot timing. That is, radio transmission of the vehicle information is performed by the transmitter 12 in the idle slot detected at Step 656. Following Step 658, Step 290 is performed.

As the CPU 14 performs the above-described program, based on detection of the existence of preceding vehicle between the subject vehicle and the intersection which performs radio signal transmission with the spread code corresponding the approach direction of the subject vehicle to the intersection, the radio apparatus 1 performs transmission with the allocated spread code at timing different from that of the preceding vehicle.

Figure 12:
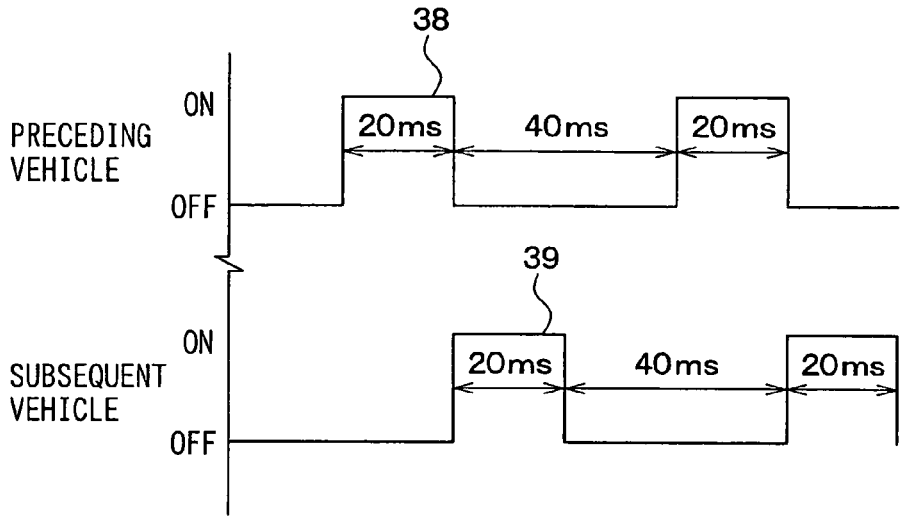
FIG. 12 is a timing chart showing relation of radio transmission timing between preceding vehicle and subsequence vehicle according to the third embodiment.

FIG. 12 is a timing chart showing the shift of radio transmission timing between preceding vehicle and subsequent vehicle in the above actuation. In the figure, the upper part indicates timing for the preceding vehicle, and the lower part indicates timing for the subject vehicle. Time periods where polygonal lines 38 and 39 are ON (in FIG. 12, each 20 milliseconds) indicate time periods where radio transmission is performed, and OFF time periods (in FIG. 12, each 40 milliseconds) indicate time periods where radio transmission is not performed. In this manner, as time periods of radio transmission by the preceding vehicle and those by the subsequent vehicle are shifted from each other, the interference between a radio signal from the vehicle and a radio signal from another vehicle can be suppressed.

Note that in the program in FIG. 11, Step 290 may be replaced with Step 590 as in the case of the second embodiment.

Fourth Embodiment

Next, regarding a fourth embodiment of the present invention, the difference from the first embodiment will be described. In the traveling direction distinction information of the present embodiment, multiple different spread codes correspond to a particular approach direction to a particular intersection. For example, regarding an intersection A, as spread codes used for transmission in the case of entry from a particular direction such as north, a spread code for a preceding vehicle and a spread code for a subsequent vehicle correspond to the direction.

The CPU 14 of the present embodiment executes a program shown in the flowchart of FIG. 13 in place of the program shown in FIG. 2. Hereinbelow, in the program of FIG. 13, the difference from FIG. 2, with processing by the CPU 14 to perform the different portion, will be described.

If it is determined at Step 220 that the traveling direction distinction information is stored in the map data regarding the intersection to which the vehicle is to pass, then at Step 730, the CPU 14 determines whether or not a preceding vehicle exists. The determination is performed by outputting a signal to use a transmission spread code for preceding vehicle corresponding to the current approach direction to the intersection included in the traveling direction distinction information, to the baseband processor 13, to try reception of signal with the spread code by using the baseband processor 13. If vehicle information with the spread code has been received, it is determined that a preceding vehicle exists, while if vehicle information has not been received for a predetermined period (e.g., 0.1 second), it is determined that no preceding vehicle exists. If it is determined that no preceding vehicle exists, Step 740 is performed, while if it is determined that a preceding vehicle exists, Step 750 is performed.

At Step 740, a code for preceding vehicle corresponding to the current approach direction to the intersection is allocated in accordance with the traveling direction distinction information.

Further, at Step 750, a code for subsequent vehicle is allocated in accordance with the traveling direction distinction information. After Steps 740 and 750, at Step 270, vehicle information of the subject vehicle is radio-transmitted with the allocated transmission code.

As the CPU 14 executes the above-described program, based on detection of the existence of preceding vehicle between the subject vehicle and the intersection which performs radio signal transmission with the spread code corresponding the approach direction of the subject vehicle to the intersection, the radio apparatus 1 allocates, of the spread codes of which the traveling direction distinction information corresponds to the approach direction to the intersection of the subject vehicle, a spread code for subsequent vehicle different from the spread code used for transmission by the preceding vehicle. Accordingly, even in a case where a preceding vehicle exists, vehicle information can be transmitted without interference with the signal from the preceding vehicle.

Figure 14:
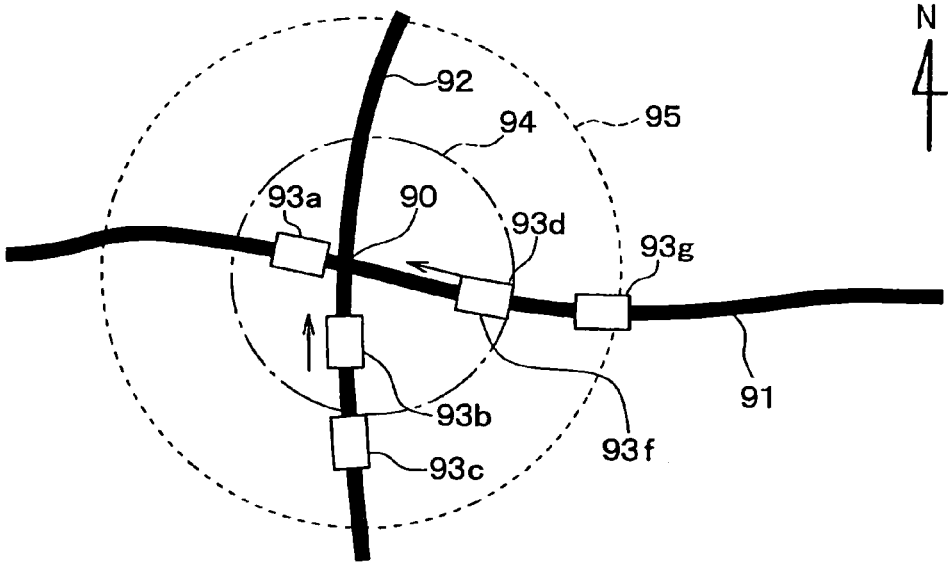
FIG. 14 is an explanatory view of roads for explaining a particular example of spread code used for transmission by a vehicle according to the fourth embodiment.

FIG. 14 is an explanatory view of roads 91 and 92 on which vehicles 93*a* to 93*g* holding the radio apparatus 1 of the present embodiment run. In this figure, as the vehicles 93*a* to 93*g* are positioned within the first predetermined distance (corresponding to the inside of circle 95) from an intersection 90 without traffic signal and with poor visibility, vehicle information is transmitted from the respective vehicles. Note that the vehicles 93*b* and 93*c*, and the vehicles 93*f* and 93*g*, running in the same direction on the same road, perform transmission with different spread codes.

Note that it may be arranged such that one spread code for subsequent vehicle is allocated to a particular approach direction to a particular intersection as described above, and further, multiple spread codes such as a spread code for the second vehicle and a spread code for the third vehicle are allocated. In this case, it may be arranged such that in the processing at Step 750, the CPU 14 tries to receive a signal including vehicle information with the spread codes, sequentially from the spread code for the second vehicle corresponding to the current approach direction to the intersection included in the traveling direction distinction information, and allocates a spread code, which has not been received, as a spread code for transmission by the subject vehicle. In this manner, even in a case where multiple preceding vehicles exist, vehicle information can be transmitted without interference with signals from these preceding vehicles.

Note that in the program of FIG. 13, Step 290 may be replaced with Step 590 as in the case of the second embodiment.

Fifth Embodiment

Next, regarding a fifth embodiment of the present invention, only the difference from the first embodiment will be described. The CPU 14 of the present embodiment executes a program shown in the flowchart of FIG. 15 in place of the program shown in FIG. 2. The difference from the flowchart in FIG. 2 is that Step 270 is replaced with Steps 752, 754 and 756, and Step 280 is replaced with Step 770.

Upon execution of the program, if it is determined at Step 250 that no preceding vehicle exists, the CPU 14 performs determination as to whether or not the vehicle has entered the second predetermined distance range from the intersection at Step 752, by processing similar to that at Step 260 in FIG. 2. Then if it is determined that the vehicle has not entered the second predetermined distance range, Step 754 is performed, while if it is determined that the vehicle has entered the second predetermined distance range, Step 756 is performed.

At Step 754, a signal to transmit vehicle information of the subject vehicle with the spread code allocated at Step 230 or 240, with first predetermined transmission power, is outputted to the baseband processor 13. The baseband processor 13 transmits the vehicle information with the first predetermined transmission power by using the transmitter 12. The first predetermined transmission power is, e.g., 10 dBm.

At Step 756, a signal to transmit the vehicle information with the spread code allocated at Step 230 or 240, with second predetermined transmission power, is outputted to the baseband processor 13. The baseband processor 13 transmits the vehicle information with the second predetermined transmission power by using the transmitter 12. The second transmission power, lower than the first predetermined transmission power, is, e.g., 0 dBm.

Further, if it is determined at Step 260 that the vehicle has entered the second predetermined distance range, the CPU 14 outputs a signal to transmit the vehicle information with the spread code allocated at Step 230 or 240, with third predetermined transmission power, to the baseband processor 13. The baseband processor 13 transmits the vehicle information with the third predetermined transmission power by using the transmitter 12. The third transmission power, lower than the first predetermined transmission power and the second predetermined transmission power, is, e.g., −10 dBm.

Following Steps 754, 756 and 770, Step 290 is performed.

As the CPU 14 executes the above-described program, in a case where no preceding vehicle exists between a vehicle and an intersection to which the vehicle is to enter, the radio apparatus 1 transmits vehicle information with the first transmission power while the vehicle runs from the intersection to the second predetermined distance. When the vehicle has entered the second predetermined distance, the radio apparatus 1 reduces the transmission power and transmits the radiowave from the vehicle with the second transmission power. This arrangement corresponds to control transmission power so as to be reduced as the distance between a vehicle and an intersection becomes shorter, in correspondence with the tendency to reduce the radiowave propagation range as the vehicle becomes closer to the intersection.

Further, in a case where a preceding vehicle exists, when the vehicle has entered the second predetermined distance, the radio apparatus 1 transmits null data with transmission power lower than that in a case where no preceding vehicle exists. By this arrangement, the interference with the preceding vehicle can be further reduced.

Figure 16:
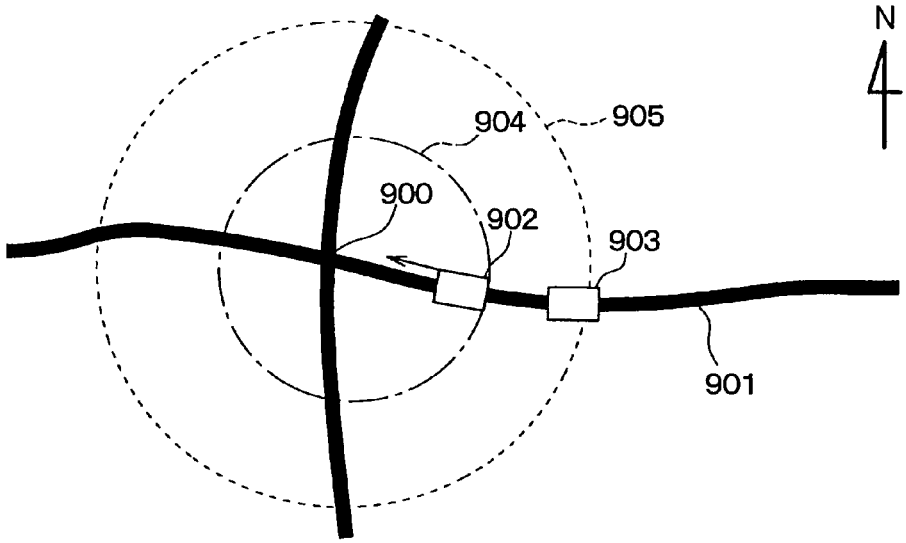
FIG. 16 is an explanatory view of roads for explaining a particular example of transmission power in the vehicle according to the fifth embodiment.

FIG. 16 is an explanatory view of roads including a road 901 where vehicles 902 and 903 holding the radio apparatus 1 of the present embodiment run. In this figure, as the vehicle 902 is positioned within the second predetermined distance (corresponding to the inside of circle 904) from an intersection 900 without traffic signal and with poor visibility, the radio apparatus 1 of the vehicle 902 performs transmission with the second transmission power. The vehicle 903 is positioned within the first predetermined distance (corresponding to the inside of circle 905) from an intersection 900. As the preceding vehicle 902 exists, the radio apparatus 1 of the vehicle 903 does not perform radio transmission. If the vehicle 902 does not exist between the vehicle 903 and the intersection 900, the radio apparatus 1 of the vehicle 903 performs transmission with the first transmission power.

Further, when the vehicle 903 has entered the second predetermined distance, if the vehicle 902 has not passed the intersection 900, the radio apparatus 1 of the vehicle 903 performs transmission with the third transmission power.

Note that in addition to the above case where the transmission power is selected based on as to whether or not the vehicle has entered the second predetermined distance, it may be arranged such that the radio apparatus 1 smoothly or multi-stepwisely selects the transmission power in accordance with the distance between the vehicle and the intersection by, e.g., performing radio transmission with transmission power in proportion to the distance between the vehicle and the intersection.

Further, in the program of FIG. 15, Step 290 may be replaced with Step 590 as in the case of the second embodiment.

Further, in the present embodiment, it may be arranged such that a subsequent vehicle transmits vehicle information at different timing or with different spread code from the timing or spread code of a preceding vehicle as in the case of the third or fourth embodiment.

Sixth Embodiment

Next, regarding a sixth embodiment of the present invention, the difference from the fourth embodiment will be described. The CPU 14 of the present embodiment executes a program shown in the flowchart of FIG. 17 in place of the program shown in FIG. 13. The difference from the flowchart in FIG. 13 is that, following Steps 230, 740 and 750, and prior to Step 270, Step 760 is inserted.

At Step 760, among signals transmitted from other roads, information in a farthest position from the vehicle is selected. Then the distance between the selected position and the vehicle is calculated, and a control signal is outputted to the baseband processor 13 so as to set transmission power corresponding to the distance (e.g., proportional to the distance).

In this arrangement, the radio apparatus 1 transmits vehicle information with transmission power which is increased as the distance between the subject vehicle and the farthest vehicle (i.e., vehicle as a destination of inter-vehicle communication) is increased. Thus power control in correspondence with the distance from the communication destination, i.e., allowable distance for radiowave propagation, is realized, and power consumption can be reduced.

Further, in the program of FIG. 15, Step 290 may be replaced with Step 590 as in the case of the second embodiment.

Further, in the present embodiment, it may be arranged such that a subsequent vehicle transmits vehicle information at different timing or with different spread code from the timing or spread code of a preceding vehicle as in the case of the third or fourth embodiment.

Seventh Embodiment

Figure 18:
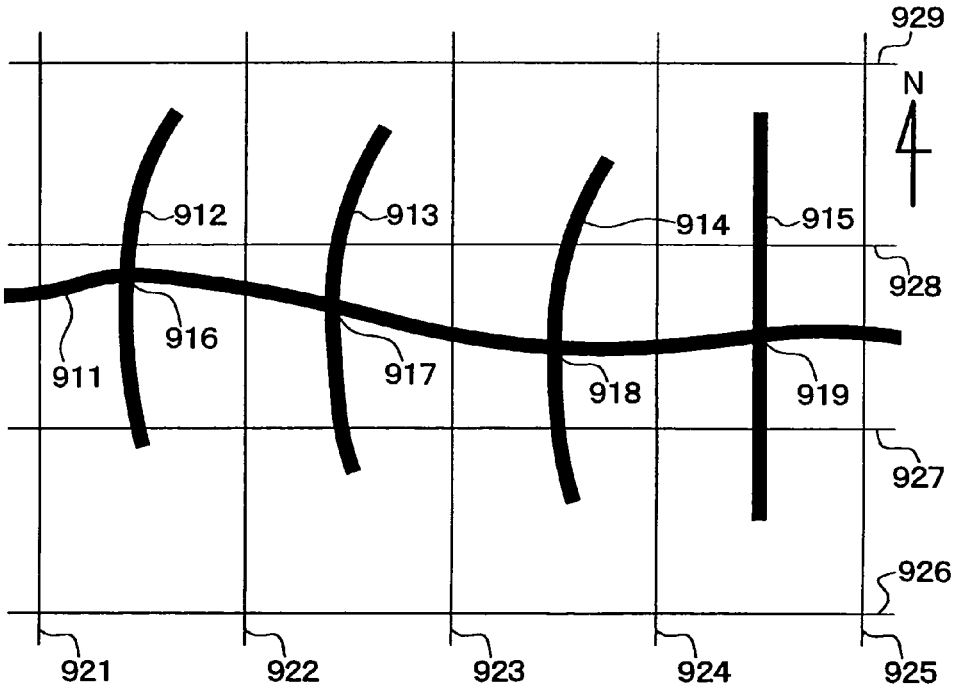
FIG. 18 is an explanatory view of roads for explaining a particular example of spread code allocation by geographical division according to a seventh embodiment.

Next, regarding a seventh embodiment of the present invention, the difference from the first embodiment will be described. Unlike the first embodiment in which approach directions and spread codes correspond to each other by intersection, in the traveling direction distinction information of the present embodiment, approach direction and spread code correspond to each other by geographical division by map code (registered trademark: the same hereinafter). FIG. 18 is an explanatory view of roads for explaining this graphical divisions. In FIG. 18, an area including roads 911 to 919 is divided into rectangular (e.g., 100 square meters) geographical divisions with parting lines 921 to 929. In the traveling direction distinction information in the map data, by each pair of identification number given to each geographical division (i.e., a map code) and an approach direction, one or more spread codes are allocated for use upon entry from the approach direction to an intersection in the division.

As the CPU 14 executes the program in FIG. 2, FIG. 11, FIG. 13, FIG. 15 or FIG. 17 based on the above-described traveling direction distinction information, the radio apparatus 1 specifies a spread code corresponding to an approach direction of a vehicle to an intersection based on a traveling direction of the vehicle and the correspondence data between an approach direction to the intersection and a spread code by geographical division.

By using this correspondence data, it is possible to perform allocation of communication channel by geographical division in a flexible manner.

Eighth Embodiment

Figure 19:
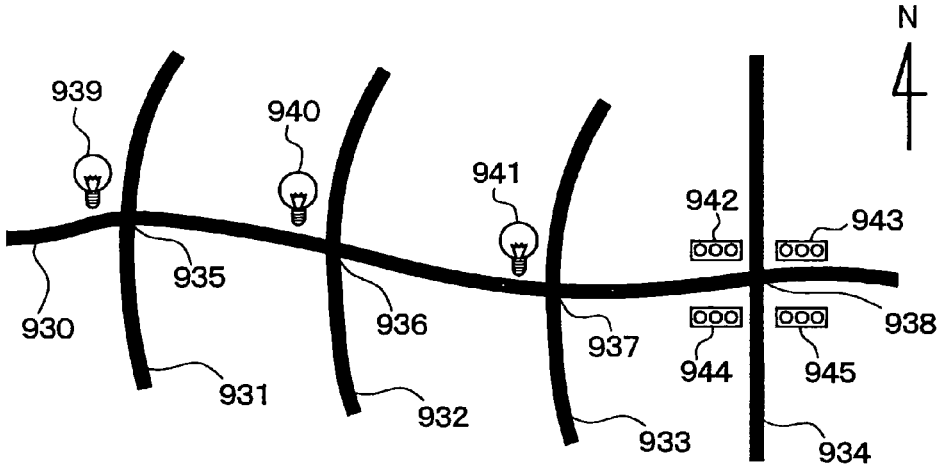
FIG. 19 is an example of map display screen image according to an eighth embodiment.

Next, an eighth embodiment of the present invention will be described. In the present embodiment, when the above-described car navigation apparatus performs map display, mark(s) indicating the actuations by the radio apparatus 1 as shown in the first to seventh embodiments is displayed in the map. In FIG. 19 including roads 931 to 934, marks 939 to 941 indicating the actuations by the radio apparatus 1 as shown in the first to seventh embodiments are displayed near intersections 935 to 937 without traffic signal, around which a visibility-reducing build exists. In this arrangement, the user can be notified of positions where radio communication for collision prevention is performed.

Further, in addition to these marks, around an intersection 938 with traffic signals, traffic signal marks 942 to 945 may be displayed.

Further, it may be arranged such that regarding only an intersection corresponding to a spread code in the traveling direction distinction information, the mark indicating the actuations by the radio apparatus 1 as shown in the first to seventh embodiments is displayed.

Ninth Embodiment

Next, a ninth embodiment of the present invention will be described. In the present embodiment, as in the case of the third and fourth embodiments, when the radio apparatus 1 of a subsequent vehicle transmits vehicle information, the radio apparatus 1 of a preceding vehicle receives the information, and forwards the information and vehicle information of the preceding vehicle, with a transmission code for the preceding vehicle, frontward.

Figure 20:
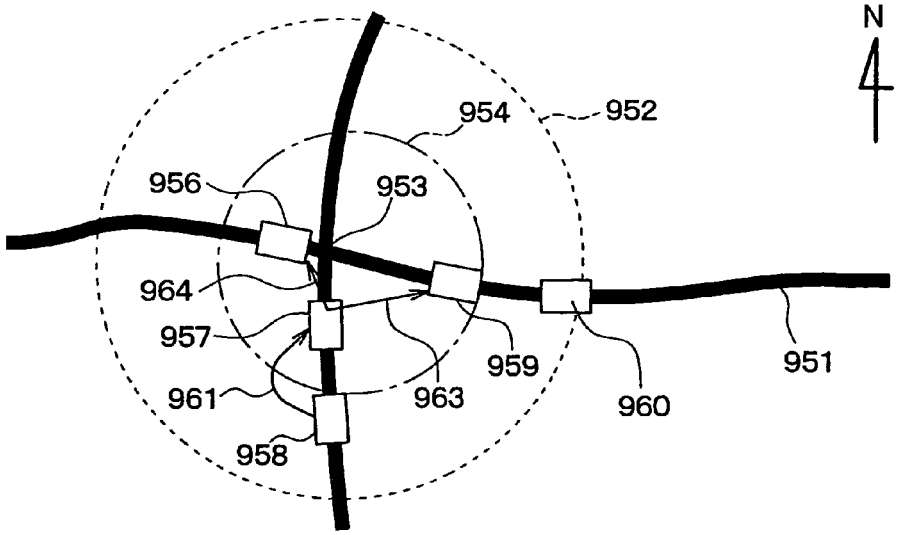
FIG. 20 is an explanatory view showing inter-vehicle communication channels according to a ninth embodiment.

More particularly, as shown in FIG. 20 including roads 951 and an area 952, a preceding vehicle 957, having a subsequent vehicles 958, receives radio waves transmitted from the subsequent vehicles 958 as indicated with arrows 961. Then the preceding vehicle 957 radio-transmits the contents of the received information to other vehicles to enter an intersection 953 from other roads as indicated with arrows 963 and 964. In this arrangement, the information on the subsequent vehicle can be more accurately transmitted to the other vehicles to enter from the other roads.

Others

Further, in the above-described embodiments, the radio apparatus 1 performs spread code allocation and transmission of vehicle information with the allocated spread code only when the vehicle has entered from an intersection into the first predetermined distance range, however, the present invention is not limited to this arrangement.

For example, it is determined whether or not the current position is included in the map data of the car navigation apparatus based on information obtained by transmitting a command inquiring about the information to the car navigation apparatus. Then if the current position is not included in the map data, a transmission spread code corresponding to an approach direction of the vehicle is specified based on predetermined correspondence between approach directions to spread codes regarding an unspecified intersection, and transmission of vehicle information or the like is performed with the allocated spread code.

Further, in the above-described embodiments, data having all 0 values is null information, however, the present invention is not limited to this data. Data having all 1 values may be used. Any information may be used as the null information as long as it does not interfere with accurate reception of vehicle information due to overlap with vehicle information transmitted with the same spread code.

Further, in the above-described embodiments, the radio apparatus 1 is used as an in-vehicle radio apparatus, however, a car navigation apparatus having a radio transmission function may be realized as the in-vehicle radio apparatus. In this case, the map data stored in a storage medium of the car navigation apparatus itself may be used.

Further, in the above-described embodiments, the radio apparatus 1 specifies a spread code corresponding to an approach direction of a vehicle into an intersection based on a traveling direction of the vehicle and correspondence data between approach directions to particular intersection and spread codes. The traveling direction of the vehicle is specified based on information from a gyroscope, a GPS receiver and the like. However, the spread code is not necessarily specified in this manner. For example, the radio apparatus 1 may specify a spread code corresponding to an approach road for a vehicle into an intersection based on a traveling direction of the vehicle and correspondence data between approach directions to particular intersection and spread codes. The approach road may be specified based on information of a road (link) where the vehicle is currently running specified by the car navigation apparatus by map matching or the like.

In this arrangement, even in a case where an approach road to an intersection is serpentine or in a case where a running speed of the vehicle is low, the approach direction of the vehicle into the intersection can be accurately transmitted in comparison with the case using a gyroscope, a GPS receiver and the like.

Further, the radio apparatus 1 may be provided in a position where an electronic number plate is mounted.

Further, it may be arranged such that at Step 220 performed by the CPU 14, if it is determined that there is no traveling direction distinction information regarding an intersection which the vehicle is to pass, the transmitter 12 is controlled not to perform radio transmission.

It will be obvious to those skilled in the art that various changes may be made in the above-described embodiments of the present invention. However, the scope of the present invention should be determined by the following claims.

What is claimed is:

1. An in-vehicle radio apparatus comprising:

a transmission unit for transmitting a radio signal by using a spread spectrum method;

a first approach determination unit for determining that a vehicle has entered a first distance from an intersection; and an allocation unit for allocating a spread code corresponding to an approach direction of the vehicle to the intersection as a spread code used for transmission by the transmission unit based on determination by the first approach determination unit, wherein the allocation unit specifies the spread code corresponding to the approach direction of the vehicle to the intersection based on a traveling direction of the vehicle, and correspondence data between approach directions to a particular intersection and spread codes, wherein in the correspondence data, a spread code in a particular approach direction to a particular intersection corresponds to a transmission end position of transmission with the spread code, and wherein the in-vehicle radio apparatus further comprises a transmission termination control unit for, when the transmission unit transmits a radio signal with a spread code allocated by the allocation unit regarding an approach direction to an intersection, terminating transmission with the spread code by the transmission unit based on passage of the vehicle across a transmission end position corresponding to the spread code for the approach direction to the intersection of the correspondence data.

2. The in-vehicle radio apparatus according to claim 1, wherein in the correspondence data, regarding continuous multiple intersections, the seine spread code corresponds to a direction continuously passing the multiple intersections along a road, and a transmission end position corresponding to the seine spread code is a position of a last intersection upon passing of the continuous multiple intersections along the road.

3. An in-vehicle radio apparatus comprising:

a transmission unit for transmitting a radio signal by using a spread spectrum method;

a first approach determination unit for determining that a vehicle has entered a first distance from an intersection; and an allocation unit for allocating a spread code corresponding to an approach direction of the vehicle to the intersection as a spread code used for transmission by the transmission unit based on determination by the first approach determination unit, wherein the allocation unit specifies the spread code corresponding to the approach direction of the vehicle to the intersection based on a traveling direction of the vehicle, and correspondence data between approach directions to a particular intersection and spread codes, and wherein regarding closely continuous intersections, the correspondence data has spread codes, corresponding to adjacent intersections, not to overlap with each other.

4. The An in-vehicle radio apparatus comprising:

a transmission unit for transmitting a radio signal by using a spread spectrum method;

a first approach determination unit for determining that a vehicle has entered a first distance from an intersection; and an allocation unit for allocating a spread code corresponding to an approach direction of the vehicle to the intersection as a spread code used for transmission by the transmission unit based on determination by the first approach determination unit, wherein the allocation unit specifies the spread code corresponding to the approach direction of the vehicle to the intersection based on a traveling direction of the vehicle, and correspondence data between approach directions to a particular intersection and spread codes, and wherein in a case where the correspondence data regarding an intersection which the vehicle is to enter can be obtained, the allocation unit allocates a spread code corresponding to an approach direction of the vehicle in the correspondence data as a spread code used for transmission by the transmission unit, and in a case where the correspondence data regarding the intersection which the vehicle is to enter cannot be obtained, the allocation unit allocates a spread code previously set corresponding to an approach direction of the vehicle as a spread code used for transmission by the transmission unit.

5. An in-vehicle radio apparatus comprising:

a transmission unit for transmitting a radio signal by using a spread spectrum method;

a first approach determination unit for determining that a vehicle has entered a first distance from an intersection; and an allocation unit for allocating a spread code corresponding to approach direction of the vehicle to the intersection as a spread code used for transmission by the transmission unit based on determination by the first approach determination unit, wherein the allocation unit specifies the spread code corresponding to the approach direction of the vehicle to the intersection based on a traveling direction of the vehicle, and correspondence data between approach directions to a particular intersection and spread codes, wherein in the correspondence data, multiple spread codes correspond to a particular approach direction to an intersection, and wherein based on detection of existence of, between the intersection and the vehicle, a preceding vehicle that performs transmission of a radio signal with the spread code corresponding to the approach direction of the vehicle to the intersection, the code allocation unit allocates, among spread codes in the correspondence data corresponding to the approach direction of the vehicle to the intersection, a spread code different from the spread code used for transmission in the preceding vehicle, as a code used for transmission by the transmission unit.

6. An in-vehicle radio apparatus comprising:

a transmission unit for transmitting a radio signal by using a spread spectrum method;

a first approach determination unit for determining that a vehicle has entered a first distance from an intersection; and an allocation unit for allocating a spread code corresponding to an approach direction of the vehicle to the intersection as a spread code used for transmission by the transmission unit based on determination by the first approach determination unit, wherein the allocation unit specifies the spread code corresponding to the approach direction of the vehicle to the intersection based on a traveling direction of the vehicle and correspondence data between an approach direction to an intersection and the spread code by geographical division.

7. An in-vehicle radio apparatus comprising:

a transmission unit for transmitting a radio signal by using a spread spectrum method;

a first approach determination unit for determining that a vehicle has entered a first distance from an intersection;

an allocation unit for allocating a spread code corresponding to an approach direction of the vehicle to the intersection as a spread code used for transmission by the transmission unit based on determination by the first approach determination unit; and a different-timing transmission control unit for, based on detection of existence of, between the intersection and the vehicle, a preceding vehicle that performs transmission of a radio signal with the spread code corresponding to the approach direction of the vehicle to the intersection, performing the transmission by the transmission unit with the spread code allocated by the allocation unit at a timing different from a timing of transmission in the preceding vehicle.

8. An in-vehicle radio apparatus comprising:

a transmission unit for transmitting a radio signal by using a spread spectrum method;

a first approach determination unit for determining that a vehicle has entered a first distance from an intersection;

an allocation unit for allocating a spread code corresponding to an approach direction of the vehicle to the intersection as a spread code used for transmission by the transmission unit based on determination by the first approach determination unit; and a preceding vehicle detection unit for detecting existence of, between the intersection and the vehicle, a preceding vehicle that performs transmission of a radio signal with the spread code corresponding to the approach the direction of the vehicle to the intersection, and based on detection, prohibiting transmission by the transmission unit with the spread code allocated by the allocation unit.

9. The in-vehicle radio apparatus according to claim 8, further comprising:

a second approach determination unit for determining that the vehicle has entered a second distance shorter than the first distance from the intersection; and a null data transmission control unit for, based on determination by the second approach determination unit, causing the transmission unit to transmit null data with the spread code allocated by the allocation unit, regardless of prohibition of transmission by the preceding vehicle detection unit.

10. The in-vehicle radio apparatus according to claim 9, wherein the null data transmission control unit causes the transmission unit to transmit the null data with transmission power lower than that when no preceding vehicle exists.

11. An in-vehicle radio apparatus comprising:

a transmission unit for transmitting a radio signal by using a spread spectrum method;

a first approach determination unit for determining that a vehicle has entered a first distance from an intersection;

an allocation unit for allocating a spread code corresponding to an approach direction of the vehicle to the intersection as a spread code used for transmission by the transmission unit based on determination by the first approach determination unit; and a first transmission power control unit for controlling transmission power of the transmission unit so that the transmission power is reduced as the distance between the vehicle and the intersection becomes shorter.

12. An in-vehicle radio apparatus comprising:

a transmission unit for transmitting a radio signal by using a spread spectrum method;

a first approach determination unit for determining that a vehicle has entered a first distance from an intersection;

an allocation unit allocating a spread code corresponding to an approach direction of the vehicle to the intersection as a spread code used for transmission by the transmission unit based on determination by the first approach determination unit;

a second approach determination unit for determining that the vehicle has entered a second distance shorter than the first distance from the intersection; and a first transmission power control unit for reducing transmission power of the transmission unit based on determination by the second approach determination unit.

13. An in-vehicle radio apparatus comprising:

a transmission unit for transmitting a radio signal by using a spread spectrum method;

a first approach determination unit for determining that a vehicle has entered a first distance from an intersection;

an allocation unit for allocating a spread code corresponding to an approach direction of the vehicle to the intersection as a spread code used for transmission by the transmission unit based on determination by the first roach determination unit;

a reception unit for trying reception of a radio signal with a spread code corresponding to an approach direction different from the approach direction of the vehicle to the intersection, based on determination by the first approach determination unit; and a second transmission power control unit for controlling transmission power of the transmission unit based on a distance between a position of a vehicle as a transmission originator included as data in the signal received by the reception unit with the spread code corresponding to the approach direction different from the approach direction of the vehicle to the intersection and a position of the vehicle.

14. An in-vehicle radio apparatus comprising:

a transmission unit for transmitting a radio signal;

a first approach determination unit for determining that a vehicle has entered a first distance from an intersection; and an allocation unit for allocating a communication channel corresponding to an approach direction of the vehicle to the intersection as a communication channel used for transmission by the transmission unit based on determination by the first approach determination unit, wherein the allocation unit specifies the communication channel corresponding to the approach direction of the vehicle to the intersection based on a traveling direction of the vehicle and correspondence data between the approach direction to a particular intersection and the communication channel, and wherein in a case where the correspondence data regarding an intersection which the vehicle is to enter can be obtained, the allocation unit allocates a communication channel corresponding to an approach direction of the vehicle in the correspondence data as a communication channel used for transmission by the transmission unit, and in a case where the correspondence data regarding the intersection which the vehicle is to enter cannot be obtained, the allocation unit allocates a communication channel previously set corresponding to an approach direction of the vehicle as a communication channel used for transmission by the transmission unit.

15. An in-vehicle radio apparatus comprising:

a transmission unit for transmitting a radio signal;

a first approach determination unit for determining that a vehicle has entered a first distance from an intersection; and an allocation unit for allocating a communication channel corresponding to an approach direction of the vehicle to the intersection as a communication channel used for transmission by the transmission unit based on determination by the first approach determination unit, wherein the allocation unit specifies the communication channel corresponding to the approach direction of the vehicle to the intersection based on a traveling direction of the vehicle and correspondence data between an approach direction to an intersection and the communication channel by geographical division.

16. An in-vehicle radio apparatus comprising:

a transmission unit for transmitting a radio signal;

a first approach determination unit for determining that a vehicle has entered a first distance from an intersection;

an allocation unit for allocating a communication channel corresponding to an approach direction of the vehicle to the intersection as a communication channel used for transmission by the transmission unit based on determination by the first approach determination unit; and a different-timing transmission control unit for, based on detection of existence of, between the intersection and the vehicle, a preceding vehicle that performs transmission of a radio signal in the communication channel corresponding to the approach direction of the vehicle to the intersection, performing the transmission by the transmission unit with the communication channel allocated by the allocation unit at a timing different from a timing of transmission in the preceding vehicle.

17. An in-vehicle radio apparatus comprising:

a transmission unit for transmitting a radio signal;

a first approach determination unit for determining that a vehicle has entered a first distance from an intersection;

an allocation unit for allocating a communication channel corresponding to an approach direction of the vehicle to the intersection as a communication channel used for transmission by the transmission unit based on determination by the first approach determination unit; and a first transmission power control unit for controlling transmission power of the transmission unit so that the transmission power is reduced as the distance between the vehicle and the intersection becomes shorter.

18. An in-vehicle radio apparatus comprising:

a transmission unit for transmitting a radio signal;

a first approach determination unit for determining that a vehicle has entered a first distance from an intersection;

an allocation unit for allocating a communication channel corresponding to an approach direction of the vehicle to the intersection as a communication channel used for transmission by the transmission unit based on determination by the first approach determination unit; and a preceding vehicle detection unit for detecting existence of, between the intersection and the vehicle, a preceding vehicle that performs transmission of a radio signal in the communication channel corresponding to the approach direction of the vehicle to the intersection, and based on the detection, prohibiting the transmission by the transmission unit in the communication channel allocated by the allocation unit.

19. The in-vehicle radio apparatus according to claim 18, further comprising:

a second approach determination unit for determining that the vehicle has entered a second distance shorter than the first distance from the intersection; and a null data transmission control unit for, based on determination by the second approach determination unit, causing the transmission unit to transmit null data in the communication channel allocated by the allocation unit, regardless of prohibition of transmission by the preceding vehicle detection unit.

20. An in-vehicle radio apparatus comprising:

a transmission unit for transmitting a radio signal;

a first approach determination unit for determining that a vehicle has entered a first distance from an intersection;

an allocation unit for allocating a communication channel corresponding to an approach direction of the vehicle to the intersection as a communication channel used for transmission by the transmission unit based on determination by the first approach determination unit;

a second approach determination unit for determining that the vehicle has entered a second distance shorter than the first distance from the intersection; and a first transmission power control unit for reducing transmission power of the transmission unit based on determination by the second approach determination unit.

21. An in-vehicle radio apparatus comprising:

a transmission unit for transmitting a radio signal;

a first approach determination unit for determining that a vehicle has entered a first distance from an intersection; and an allocation unit for allocating a communication channel corresponding to an approach direction of the vehicle to the intersection as a communication channel used for transmission by the transmission unit based on determination by the first approach determination unit, wherein regarding closely continuous intersections, the communication channels that correspond to adjacent intersections do not overlap with each other.

22. An in-vehicle radio apparatus comprising:

a transmission unit for transmitting a radio signal by using a spread spectrum method;

a first approach determination unit for determining that a vehicle has entered a first distance from an intersection; and an allocation unit for allocating a spread code corresponding to an approach direction of the vehicle to the intersection as a spread code used for transmission by the transmission unit based on determination by the first approach determination unit, wherein the allocation unit specifies the spread code corresponding to the approach direction of the vehicle to the intersection based on a traveling direction of the vehicle, and correspondence data between approach directions to a particular intersection and spread codes, wherein regarding closely continuous intersections along the same road and associated with the same approach direction, the correspondence data has spread codes, corresponding to adjacent intersections, that overlap with each other, and wherein regarding closely continuous intersections associated with different approach directions or the same approach direction on different roads, the correspondence data has spread codes, corresponding to adjacent intersections, that do not overlap with each other.

23. The in-vehicle radio apparatus according to claim 22, wherein regarding continuous multiple intersections at standard or shorter intervals along the same road and associated with the same approach direction, the same spread code is associated with the continuous multiple intersections.

* * * * *

UNITED STATES PATENT AND TRADEMARK OFFICE

CERTIFICATE OF CORRECTION

PATENT NO. : 7,342,509 B2
APPLICATION NO. : 11/036142
DATED : March 11, 2008
INVENTOR(S) : Nobutaka Tauchi It is certified that error appears in the above-identified patent and that said Letters Patent is hereby corrected as shown below:

On the Title Page, should read,

Item (30), as Foreign Application Priority Data:

Jan. 22, 2004 (JP) .....2004-014364
"Nov. 4, 2004" (JP) .....2004-320591

Signed and Sealed this

Seventeenth Day of March, 2009

John Doll

JOHN DOLL
*Acting Director of the United States Patent and Trademark Office*